US010965058B2

(12) United States Patent
Zheng et al.

(10) Patent No.: US 10,965,058 B2
(45) Date of Patent: Mar. 30, 2021

(54) POWER CONNECTOR

(71) Applicant: Molex, LLC, Lisle, IL (US)

(72) Inventors: You-Xiang Zheng, Pudong (CN); Hao Yin, Pudong (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/777,889

(22) Filed: Jan. 31, 2020

(65) Prior Publication Data

US 2020/0220301 A1 Jul. 9, 2020

Related U.S. Application Data

(62) Division of application No. 16/434,178, filed on Jun. 7, 2019, now Pat. No. 10,644,443, which is a division
(Continued)

(30) Foreign Application Priority Data

Jun. 23, 2017 (CN) ..... 201710488295.5

(51) Int. Cl.
*H01R 13/627* (2006.01)
*H01R 13/436* (2006.01)
(Continued)

(52) U.S. Cl.
CPC ..... *H01R 13/6272* (2013.01); *H01R 4/185* (2013.01); *H01R 13/428* (2013.01);
(Continued)

(58) Field of Classification Search
CPC ..... H01R 13/6272; H01R 13/428; H01R 13/057; H01R 13/114; H01R 13/4223
(Continued)

(56) References Cited

U.S. PATENT DOCUMENTS 4,160,575 A 7/1979 Schraut
4,319,799 A 3/1982 Pearce
(Continued)

FOREIGN PATENT DOCUMENTS

CN 1218311 A 6/1999
CN 1238577 A 12/1999
(Continued)

OTHER PUBLICATIONS

Notice of Allowance received for U.S. Appl. No. 16/007,049, dated Apr. 9, 2019, 10 pages.
(Continued)

*Primary Examiner* — Harshad C Patel

(57) ABSTRACT

The present disclosure relates to a power connector which comprises an insulative housing and a terminal. The insulative housing defines a terminal receiving groove therein and comprises a stopping wall. The terminal is positioned in the terminal receiving groove and comprises a mating portion, a stopping portion and a wire connecting portion. The stopping portion abuts against the stopping wall and comprises a first horizontal portion and a second horizontal portion. The first horizontal portion comprises a first front end edge. The second horizontal portion comprises a second front end edge. A portion of a front end of the first horizontal portion and a portion of a front end of the second horizontal portion are cut off, therefore when the terminal clamps the wire, the first front end edge and the second front end edge do not splay forwardly and outwardly to protrude forwardly, but are parallel to each other or respectively extend backwardly, which thus can avoid the first front end edge and the second front end edge of the stopping portion from abutting against the stopping wall first due to the protruding.

2 Claims, 20 Drawing Sheets

Related U.S. Application Data of application No. 16/007,049, filed on Jun. 13, 2018, now Pat. No. 10,381,775.

(51) Int. Cl.

| | |
|---|---|
| ***H01R 4/18*** | (2006.01) |
| ***H01R 13/428*** | (2006.01) |
| *H01R 13/05* | (2006.01) |
| *H01R 13/11* | (2006.01) |
| *H01R 13/422* | (2006.01) |

(52) U.S. Cl.
CPC ..... *H01R 13/4368* (2013.01); *H01R 13/057* (2013.01); *H01R 13/114* (2013.01); *H01R 13/4223* (2013.01)

(58) Field of Classification Search
USPC ..... 439/357, 850–862, 752, 378, 379, 380
See application file for complete search history.

(56) References Cited

U.S. PATENT DOCUMENTS

| | | | | |
|---|---|---|---|---|
| 4,557,542 | A * | 12/1985 | Coller | H01R 13/4364 439/595 |
| 4,959,023 | A | 9/1990 | Watanabe et al. | |
| 4,963,102 | A | 10/1990 | Gettig et al. | |
| 4,998,896 | A | 3/1991 | Lundergan | |
| 5,240,439 | A * | 8/1993 | Egenolf | H01R 13/18 439/745 |
| 5,458,511 | A | 10/1995 | Sasai et al. | |
| 5,520,548 | A | 5/1996 | Hotea et al. | |
| 5,595,509 | A * | 1/1997 | Fry | H01R 13/4362 439/595 |
| 5,643,015 | A | 7/1997 | Wakata | |
| 5,683,272 | A | 11/1997 | Abe | |
| 5,720,623 | A | 2/1998 | Polenick et al. | |
| 5,738,551 | A | 4/1998 | Matsuoka | |
| 5,741,162 | A * | 4/1998 | Kourimsky | H01R 13/432 439/746 |
| 5,791,923 | A | 8/1998 | Picaud et al. | |
| 5,947,763 | A | 9/1999 | Alaksin | |
| 5,989,066 | A * | 11/1999 | Cox | H01R 13/4365 439/595 |
| 5,997,363 | A * | 12/1999 | Joly | H01R 13/521 439/748 |
| 6,010,377 | A | 1/2000 | Dechelette et al. | |
| 6,106,340 | A | 8/2000 | Myer et al. | |
| 6,319,074 | B1 * | 11/2001 | Kashiyama | H01R 13/4362 439/752 |
| 6,331,377 | B2 * | 12/2001 | Bae | H01L 21/76816 430/313 |
| 6,383,011 | B2 | 5/2002 | Chen | |
| 6,551,151 | B2 | 4/2003 | Suzuki | |
| 6,692,289 | B2 | 2/2004 | Nemoto | |
| 6,796,836 | B2 * | 9/2004 | Ichida | H01R 13/113 439/595 |
| 6,939,159 | B1 | 9/2005 | Klein et al. | |
| 6,971,924 | B2 * | 12/2005 | Fujita | H01R 13/516 439/701 |
| 7,063,567 | B2 * | 6/2006 | Ishikawa | H01R 13/4223 439/595 |
| 7,090,547 | B2 * | 8/2006 | Machida | H01R 13/04 439/825 |
| 7,097,503 | B2 * | 8/2006 | Tsuji | H01R 13/4365 439/595 |
| 7,179,135 | B2 | 2/2007 | Osada et al. | |
| 7,241,190 | B2 | 7/2007 | Smyk | |
| 7,252,557 | B2 * | 8/2007 | Nakamura | H01R 13/4534 439/752 |
| 7,311,319 | B1 * | 12/2007 | Ortega | A61H 3/04 280/87.021 |
| 7,347,710 | B2 | 3/2008 | Ohtaka et al. | |
| 7,413,479 | B1 | 8/2008 | Volpone | |
| 7,544,081 | B2 | 6/2009 | Lim | |
| 7,559,787 | B2 | 7/2009 | Shigeta et al. | |
| 8,021,199 | B2 | 9/2011 | Ambo et al. | |
| 8,337,235 | B2 | 12/2012 | Mizutani et al. | |
| 8,708,759 | B2 * | 4/2014 | Hirabayashi | H01R 13/113 439/852 |
| 8,784,144 | B2 * | 7/2014 | Hirabayashi | H01R 13/113 439/852 |
| 9,444,172 | B2 * | 9/2016 | Kawakami | H01R 13/114 |
| 9,608,353 | B1 * | 3/2017 | Ang | H01R 13/26 |
| 10,381,775 | B2 | 8/2019 | Zheng et al. | |
| 2002/0028611 | A1 | 3/2002 | Hatagishi et al. | |
| 2002/0111060 | A1 | 8/2002 | Challis et al. | |
| 2002/0123260 | A1 * | 9/2002 | Ichio | H01R 13/4361 439/352 |
| 2003/0096540 | A1 | 5/2003 | Smyk | |
| 2003/0190830 | A1 * | 10/2003 | Tanaka | H01R 13/5208 439/271 |
| 2004/0005821 | A1 * | 1/2004 | Nankou | H01R 13/4223 439/752 |
| 2008/0276457 | A1 | 11/2008 | Furuya et al. | |
| 2013/0273764 | A1 * | 10/2013 | Kitajima | H01R 13/4362 439/345 |
| 2015/0380863 | A1 | 12/2015 | Uchida | |
| 2017/0025778 | A1 * | 1/2017 | Ang | H01R 13/05 |
| 2017/0170593 | A1 * | 6/2017 | Uezono | H01R 13/642 |

FOREIGN PATENT DOCUMENTS

| | | | |
|---|---|---|---|
| CN | 2874851 | Y | 2/2007 |
| CN | 100428577 | C | 10/2008 |
| CN | 202196929 | U | 4/2012 |
| CN | 202585817 | U | 12/2012 |
| CN | 103427204 | A | 12/2013 |
| CN | 203589274 | U | 5/2014 |
| CN | 203596459 | U | 5/2014 |
| CN | 104638417 | A | 5/2015 |
| CN | 204424524 | U | 6/2015 |
| EP | 0420255 | A1 | 4/1991 |
| GB | 2375662 | A | 11/2002 |
| JP | S50-113883 | U | 9/1975 |
| JP | S58-134881 | U | 9/1983 |
| JP | S59-279 | U | 1/1984 |
| JP | H09-129297 | A | 5/1997 |
| JP | H10-032036 | A | 2/1998 |
| JP | 2000-133366 | A | 5/2000 |
| JP | 2002-373735 | A | 12/2002 |
| JP | 2011-014420 | A | 1/2011 |
| JP | 2014-059960 | A | 4/2014 |
| KR | 10-2003-0025781 | A | 3/2003 |
| KR | 10-2009-0103401 | A | 10/2009 |
| KR | 10-2015-0027406 | A | 3/2015 |
| KR | 10-1578125 | B1 | 12/2015 |

OTHER PUBLICATIONS

Office Action received for Korean application No. 10-2018-0070609, dated Mar. 11, 2019, 6 pages. (3 pages of English translation and 3 pages of official copy).

Notice of Allowance received for Korean application No. 10-2018-0070609, dated Jul. 2, 2019, 2 pages. (1 page of English translation and 1 page of official copy).

Office Action received for Japanese application No. 2018-104455, dated Jun. 25, 2019, 6 pages. (3 pages of English translation and 3 pages of official copy).

Notice of Allowance received for U.S. Appl. No. 16/434,178, dated Jan. 23, 2020, 10 pages.

Notification of Reasons for Refusal received for JP application No. 2019-130083, dated Jul. 14, 2020, 8 pages. (4 pages of english translation and 4 pages of official copy).

First Office Action and Search Report received for CN application No. 202010064946.X, dated Nov. 3, 2020, 19 pages. (10 pages of English translation and 9 pages of Official copy).

* cited by examiner

POWER CONNECTOR

RELATED APPLICATIONS

This application is a divisional of U.S. patent application Ser. No. 16/434,178, filed Jun. 7, 2019, which is a divisional of U.S. patent application Ser. No. 16/007,049, filed Jun. 13, 2018, which claims priority to Chinese Application No. 201710488295.5, filed Jun. 23, 2017, each of which are incorporated herein by reference in their entireties.

TECHNICAL FIELD

The present disclosure relates to a power connector, and particularly to a power connector comprising an insulative housing and a terminal.

BACKGROUND ART

A power connector has been widely used in electronic products, and comprises a terminal for connecting a wire and an insulative housing receiving the terminal.

FIG. 1 is an exploded schematic view of an existing power connector, FIG. 2 is a assembled schematic view of the existing power connector of FIG. 1, which are disclosed in U.S. Pat. No. 5,458,511. Referring to FIG. 1, the existing power connector comprises an insulative housing A1 and a terminal A3, the terminal A3 comprises a stopping portion A31. Referring to FIG. 2, the insulative housing A1 comprises a stopping wall A11. When the terminal A3 is mounted in the insulative housing A1, the terminal A3 are fixed by that the stopping portion A31 of the terminal A3 abuts against the stopping wall A11. FIG. 3 and FIG. 4 are schematic views of the terminal A3 of the existing power connector. FIG. 3 shows a state before the terminal A3 clamps a wire, FIG. 4 shows a state after the terminal A3 clamps the wire. Referring to FIG. 3 and FIG. 4, before the terminal A3 clamps the wire, two front end edges A311 of the stopping portion A31 are horizontal; after the terminal A3 clamps the wire, the two front end edges A311 of the stopping portion A31 protrude forwardly due to a bending and wire pressing process, the amount of the protruding is varied with the variation of the bending and wire pressing process with respect to the terminal, and the amounts of the protruding of the two front end edges A311 may also be varied. When the terminal A3 is mounted in the insulative housing A1, what will abut against the stopping wall A11 of the insulative housing A1 first are the two front end edges A311 which protrude forwardly, thereby resulting in that the terminal A3 cannot be mounted to a correct position.

FIG. 5 is an exploded schematic view illustrating an existing power connector set, which is disclosed in Chinese Patent Application No. CN01109445.1 (Chinese Patent issued Publication No.: CN100428577C). Referring to FIG. 5, the existing power connector set comprises a first insulative housing B1, a second insulative housing B2 and a lock assembly B11. The first insulative housing B1 is, for example, an insulative housing of a receptacle connector, the second insulative housing B2 is, for example, an insulative housing of a plug connector. The lock assembly B11 is mounted on an outer surface of the first insulative housing B1. The second insulative housing B2 comprises a protruding block B21. The first insulative housing B1 and the second insulative housing B2 are assembled with each other by that the lock assembly B11 and the protruding block B21 of the second insulative housing B2 are latched with each other. FIG. 6 is a structural schematic view illustrating the first insulative housing B1 and the lock assembly B11. Referring to FIG. 6, the lock assembly B11 comprises two legs B111, a pressing handle B112, two elastic arms B113 and a latch arm B114. The lock assembly B11 increases rigidity of the pressing handle B112 to properly reinforce mutual latching force and improve mechanical strength of the connector. However, in the existing power connector, the elastic arms B113 extend outwardly from the pressing handle B112 and then directly connect downwardly with the first insulative housing B1, which results in poor flexibility of the lock assembly B11, makes the pressing handle B112 difficult to press down and operate. In addition, the latch arm B114 of the existing power connector is a piece which is entirely solid, a thickness of the latch arm B114 is large, which will increase the difficulty of manufacturing, particularly result in uneven wall thickness in the mold injection process, and result in the subsequent problem of sink mark deformation.

SUMMARY

In view of the above description of the background, the present disclosure includes the following objectives: improving the problem of protruding of the front end edge of the stopping portion of the terminal due to the bending and wire pressing process in the existing power connector, so that the terminals can be mounted to the correct position in the insulative housing; improving the problem of poor flexibility of the lock assembly in the existing power connector, so as to maintain the mechanical strength while improve the elasticity and flexibility of the lock assembly; and reinforcing the fixing of the male terminal by the design of the clamping arms of the terminal and the rib portion of the insulative housing, ensuring good contact performance of the power connector.

An embodiment of the present disclosure provides a power connector which comprises an insulative housing and a terminal. The insulative housing defines a terminal receiving groove therein, the insulative housing comprises a stopping wall. The terminal is positioned in the terminal receiving groove of the insulative housing, the terminal comprising a mating portion, a stopping portion and a wire connecting portion. The stopping portion connects with the mating portion, the stopping portion abuts against the stopping wall of the insulative housing and comprises a first horizontal portion, a second horizontal portion, a first vertical portion, a second vertical portion, a first bent portion and a second bent portion. The first horizontal portion comprises: a first front end edge; a first rear end edge facing the first front end edge, the first front end edge and the first rear end edge are positioned in a front-rear direction; and a first free end edge connecting the first front end edge and the first rear end edge and extending in the front-rear direction. The second horizontal portion faces the first horizontal portion, the first horizontal portion and the second horizontal portion are positioned in a left-right direction, the second horizontal portion comprises: a second front end edge; a second rear end edge facing the second front end edge, the second front end edge and the second rear end edge are positioned in the front-rear direction; and a second free end edge connecting the second front end edge and the second rear end edge and extending in the front-rear direction. The first vertical portion is perpendicular to the first horizontal portion and extends in an up-down direction. The second vertical portion is perpendicular to the second horizontal portion and extends in the up-down direction, the first vertical portion and the second vertical portion are positioned in the left-right direction. The first bent portion connects the first horizontal portion and the first vertical portion. The second bent portion connects the second horizontal portion and the second vertical portion. The wire connecting portion connects with the stopping portion. The first front end edge of the first horizontal portion and the second front end edge of the second horizontal portion extend parallel to each other or respectively extend backwardly, the distance between the first vertical portion and the second vertical portion of the stopping portion of the terminal becomes gradually narrower backwardly, a distance between the first free end edge and the second free end edge of the stopping portion of the terminal becomes gradually narrower backwardly.

In some embodiments, the first rear end edge and the second rear end edge of the stopping portion of the terminal respectively extend forwardly.

In some embodiments, the insulative housing further comprises a slope, the slope is positioned at a bottom portion of the terminal receiving groove of the insulative housing and ascends from rear to front in the front-rear direction; the stopping wall of the insulative housing is positioned at a top portion of the terminal receiving groove; the top portion and the bottom portion of the terminal receiving groove are positioned in the up-down direction.

In some embodiments, the mating portion of the terminal further defines an engaging opening; the insulative housing further comprises an elastic arm positioned in the terminal receiving groove of the insulative housing, the elastic arm comprises: a first end connected to the insulative housing; a second end being a free end; and an engaging protrusion formed between the first end and the second end and protruding into the terminal receiving groove, the engaging protrusion is latched with the engaging opening of the mating portion of the terminal.

In some embodiments, the mating portion of the terminal further defines an engaging opening; the insulative housing further comprises an elastic arm positioned in the terminal receiving groove of the insulative housing, the elastic arm comprises: a first end connected to the insulative housing; a second end connected to the insulative housing; and an engaging protrusion formed between the first end and the second end and protruding into the terminal receiving groove, the engaging protrusion is latched with the engaging opening of the mating portion of the terminal.

In some embodiments, the stopping wall of the insulative housing is positioned at a top portion of the terminal receiving groove; the elastic arm of the insulative housing is positioned at a bottom portion of the terminal receiving groove; the top portion and the bottom portion of the terminal receiving groove are positioned in the up-down direction.

Another embodiment of the present disclosure provides a power connector which comprises: an insulative housing; a lock assembly provided to an upper surface of the insulative housing and positioned in an up-down direction with the insulative housing. The lock assembly comprises a frame, a first leg, a second leg, a first elastic arm and a second elastic arm. The frame defines an opening therein, the frame comprises: a front bracket; a rear bracket facing the front bracket and spaced apart from the front bracket by the opening, and the front bracket and the rear bracket are positioned in a front-rear direction; a first side bracket extending in the front-rear direction and connecting the front bracket and the rear bracket; and a second side bracket facing the first side bracket, spaced apart from the first side bracket by the opening and connecting the front bracket and the rear bracket, the first side bracket and the second side bracket are positioned in a left-right direction, the opening is formed by the front bracket, the rear bracket, the first side bracket, and the second side bracket; and a first leg positioned between the front bracket and the rear bracket of the frame and extending from the first side bracket of the frame to the insulative housing in the up-down direction and connecting with the insulative housing. The second leg is positioned between the front bracket and the rear bracket of the frame and extends from the second side bracket of the frame to the insulative housing in the up-down direction and connects with the insulative housing, The first elastic arm extends outwardly from a first end of the rear bracket of the frame in the left-right direction, and then extends toward the front bracket of the frame in the front-rear direction, and then extends in the up-down direction to the insulative housing and connects with the insulative housing. The second elastic arm extends outwardly from a second end of the rear bracket of the frame in the left-right direction, and then extends toward the front bracket of the frame in the front-rear direction, and then extends in the up-down direction to the insulative housing and connects with the insulative housing.

In some embodiments, the insulative housing is correspondingly assembled with an external insulative housing of an external power connector in the front-rear direction, a protruding block is provided to an outer surface of the external insulative housing and latched with the opening of the lock assembly of the insulative housing.

In some embodiments, the insulative housing further comprises two side walls positioned in the left-right direction, two latching blocks positioned in the up-down direction are provided to each of the two side walls, a guiding rib extending the front-rear direction is provided between the two latching blocks of each of the two side walls.

In some embodiments, the front bracket, the rear bracket, the first side bracket, and the second side bracket of the frame are thin cylinders and sizes thereof can avoid a sink mark deformation due to an uneven wall thickness of a mold injection in manufacturing of the frame.

Another embodiment of the present disclosure provides a power connector which comprises an insulative housing defining a terminal receiving groove therein. The insulative housing comprises: a rib portion protruding from the insulative housing into the terminal receiving groove; and a terminal positioned in the terminal receiving groove of the insulative housing. The terminal comprises a mating portion, a clamping portion and a wire connecting portion. The clamping portion connects with the mating portion, the clamping portion comprises: a first side wall; a second side wall facing the first side wall, the first side wall and the second side wall are positioned in a left-right direction; a first clamping arm having two first end portions and a first middle portion positioned between the two first end portions, the two first end portions are respectively connected with the first side wall, the first middle portion protrudes toward the second side wall; and a second clamping arm having two second end portions and a second middle portion positioned between the two second end portions, the two second end portions are respectively connected with the second side wall, the second middle portion protrudes toward the first side wall. The first middle portion of the first clamping arm and the second middle portion of the second clamping arm clamp and are fixed to the rib portion of the insulative housing. The wire connecting portion connects with the clamping portion.

In some embodiments, the insulative housing further comprises two side walls positioned in the left-right direction, a stopping block extending into the terminal receiving groove is provided to each of the two side walls, the stopping blocks of the two side walls support the terminal.

In an embodiment of the present disclosure, the first front end edge and the second front end edge are formed by respectively cutting off a portion of a front end of the first horizontal portion and a portion of a front end of the second horizontal portion. therefore when the terminal clamps the wire, the first front end edge and the second front end edge do not splay forwardly and outwardly to protrude forwardly, but extend parallel to each other or respectively extend backwardly, which can avoid the first front end edge and the second front end edge of the stopping portion of the terminal from abutting against the stopping wall of the first insulative housing first if the first front end edge and the second front end edge protrude forwardly. Therefore, the terminal of the present disclosure can be mounted to the correct position in the first insulative housing.

In an embodiment of the present disclosure, the cut-off portion of the first horizontal portion and first bent portion and the cut-off portion of the second horizontal portion and second bent portion in the stopping portion start from left and right root portions of the front edges of the first bent portion and the second bent portion respectively, and extend backwardly toward each other. Compared to only cutting off a portion of the first horizontal portion and a portion of the second horizontal portion, the embodiment can also more effectively avoid the first front end edge and the second front end edge from splaying forwardly and outwardly to protrude forwardly due to the bending and wire pressing process for the terminal clamping the wire, and also ensure that the terminal can be mounted to the correct position in the first insulative housing.

In an embodiment of the present disclosure, the present disclosure increases both the mechanical strength and flexibility of the lock assembly through the first elastic arm and the second elastic arm. Different from the prior art, the first elastic arm and the second elastic arm do not extend outwardly respectively from the left and right ends of the rear bracket of the lock assembly and then directly connect downwardly with the first insulative housing, but the first elastic arm and the second elastic arm extend outwardly respectively from the left and right ends of the rear bracket of the lock assembly, then firstly extend forwardly by a certain distance, and then connects downwardly with the first insulative housing. This design can increase the flexibility of the lock assembly and avoid the problem that the pressing handle of the lock assembly in the prior art is difficult to press down. That is, the present disclosure makes it easier to assemble or disassemble the first insulative housing and the second insulative housing.

In an embodiment of the present disclosure, the opening of the frame of the lock assembly occupies a relatively large area of the frame in the up-down direction. In addition, the front bracket, the rear bracket, the first side bracket, and the second side bracket of the frame are thin cylinders. Accordingly, this design can avoid the sink mark deformation due to an uneven wall thickness of the mold injection in manufacturing of the frame. The lock member in the prior art is a thick solid block (for example the latch arm) or has a small opening, because the wall thickness is too thick, uneven filling occurs during injection molding and the uneven filling together with subsequent thermal expansion and contraction easily make the lock member deformed.

In an embodiment of the present disclosure, the terminal may be a male terminal. Generally, in the design of the power connector, in order to ensure good contact performance, the female terminal is movable in the plastic body, and the plug terminal is less movable as possible. The present disclosure utilizes the cooperation between the first clamping arm and the second clamping arm of the terminal and the rib portion of the second insulative housing to reinforce the fixing of the terminal.

BRIEF DESCRIPTION OF THE DRAWINGS

The various respects of the present disclosure may be best understood by the following detailed description in connection with the accompanying figures. It should be noted that, according to a standard implementing mode of the industries, features are not drawn as the scale. In practice, for the sake of clear explanation, various features may be arbitrarily enlarged or reduced in dimension.

DETAILED DESCRIPTION OF THE PREFERRED EMBODIMENTS

The following disclosed content provides various embodiments or exemplifications used to implement various features of the present disclosure. Specific examples of elements and configurations are described as follows, so as to simplify the disclosed content of the present disclosure. Certainly, these are merely examples, and are not used to limit the present disclosure. For example, in the following description, that a first feature is formed on or above a second feature may comprise an embodiment that the first feature and the second feature are formed to directly contact with each other, may also comprise an embodiment that other feature is formed between the first feature and the second feature, therefore the first feature and the second feature do not directly contact with each other. Moreover, the present disclosure may allow a symbol and/or a character of an element to be repeated in different examples. The repetition is used for simplification and clearness, but is not used to dominate a relationship between various embodiments and/or discussed structures.

Moreover, the present disclosure may use spatial corresponding terminologies, such as simple express of "below", "lower than", "relative lower", "higher than", "relative high" and the like, so as to describe a relationship between an elements or feature and another element or feature. Spatial corresponding terminologies are used to comprise various orientations of a device in use or operation besides orientations illustrated in figures. The device may be orientated (rotated by 90 degrees or in other orientation), and the corresponding spatial description in the present disclosure may be correspondingly explained. It should be understood that, when a feature is formed to another feature or above a substrate, other feature may presented between them.

Figure 1:
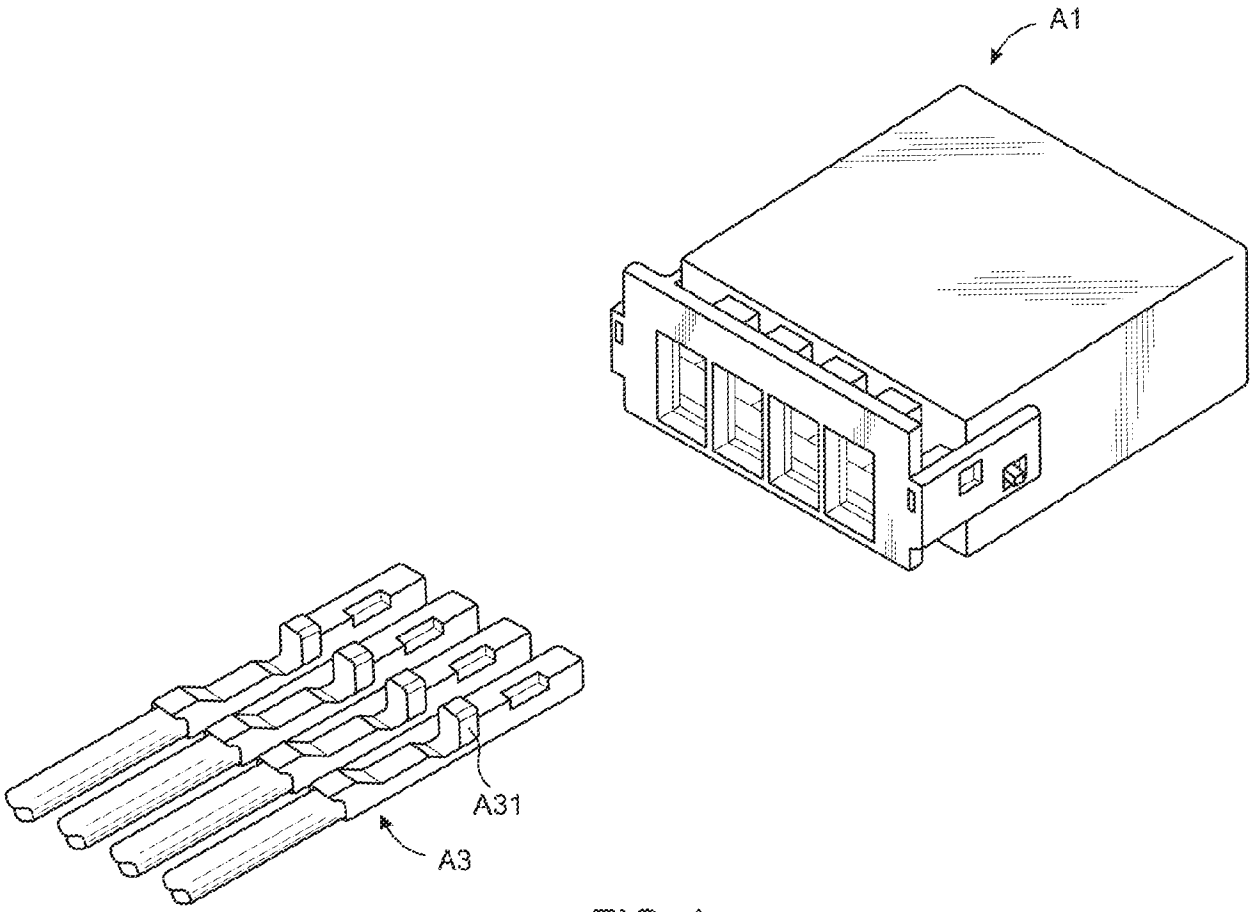
FIG. 1 (Prior Art)
FIG. 1 is an exploded schematic view illustrating an existing power connector.
Figure 2:
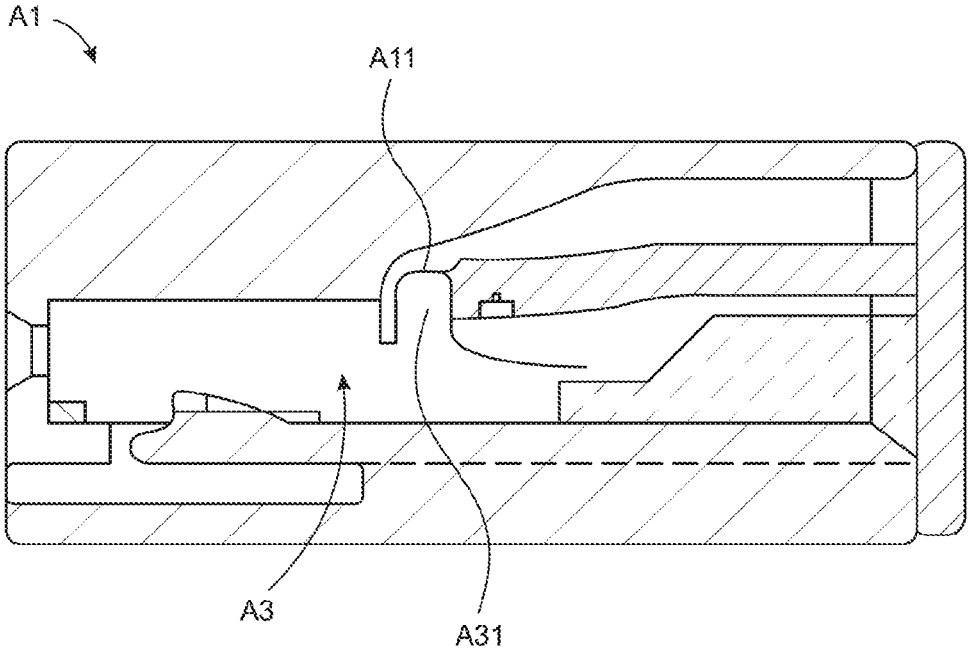
FIG. 2 (Prior Art)
FIG. 2 is an assembled schematic view illustrating the existing power connector of FIG. 1.
Figure 3:
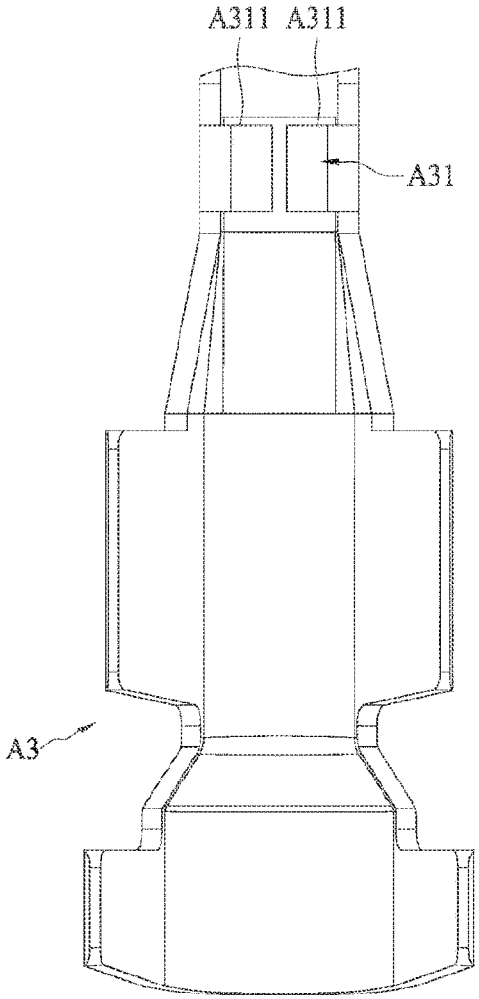
FIG. 3 Prior Art
FIG. 3 is a schematic view illustrating a terminal of the existing power connector of FIG. 1 before clamping a wire.
Figure 4:
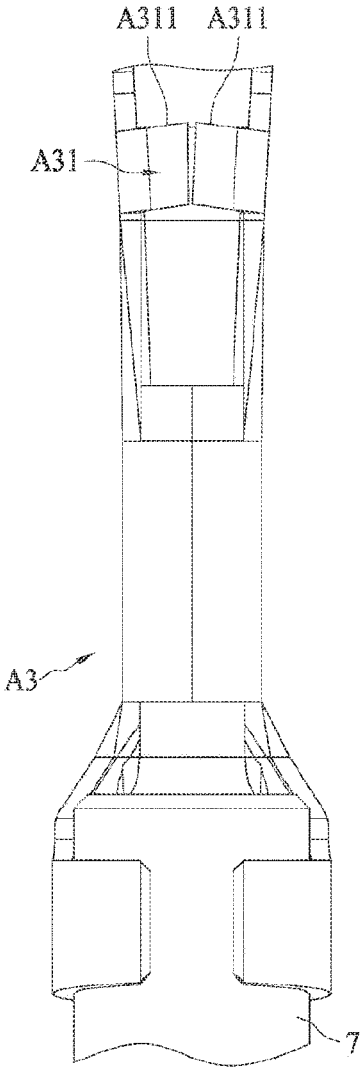
FIG. 4 Prior Art
FIG. 4 is a schematic view illustrating the terminal of the existing power connector of FIG. 1 after clamping the wire.
Figure 5:
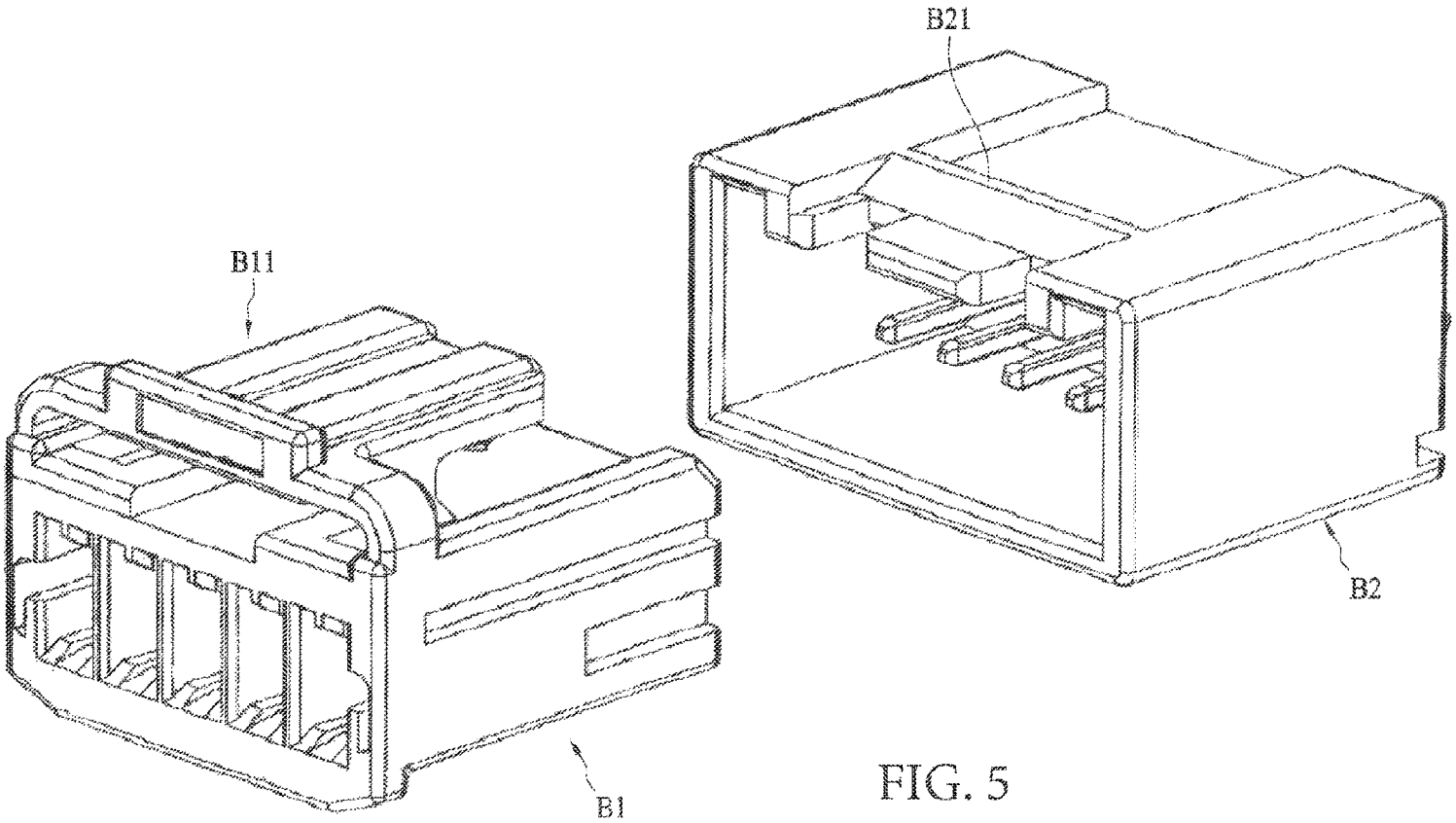
FIG. 5 Prior Art
FIG. 5 is an exploded schematic view illustrating an existing power connector set.
Figure 6:
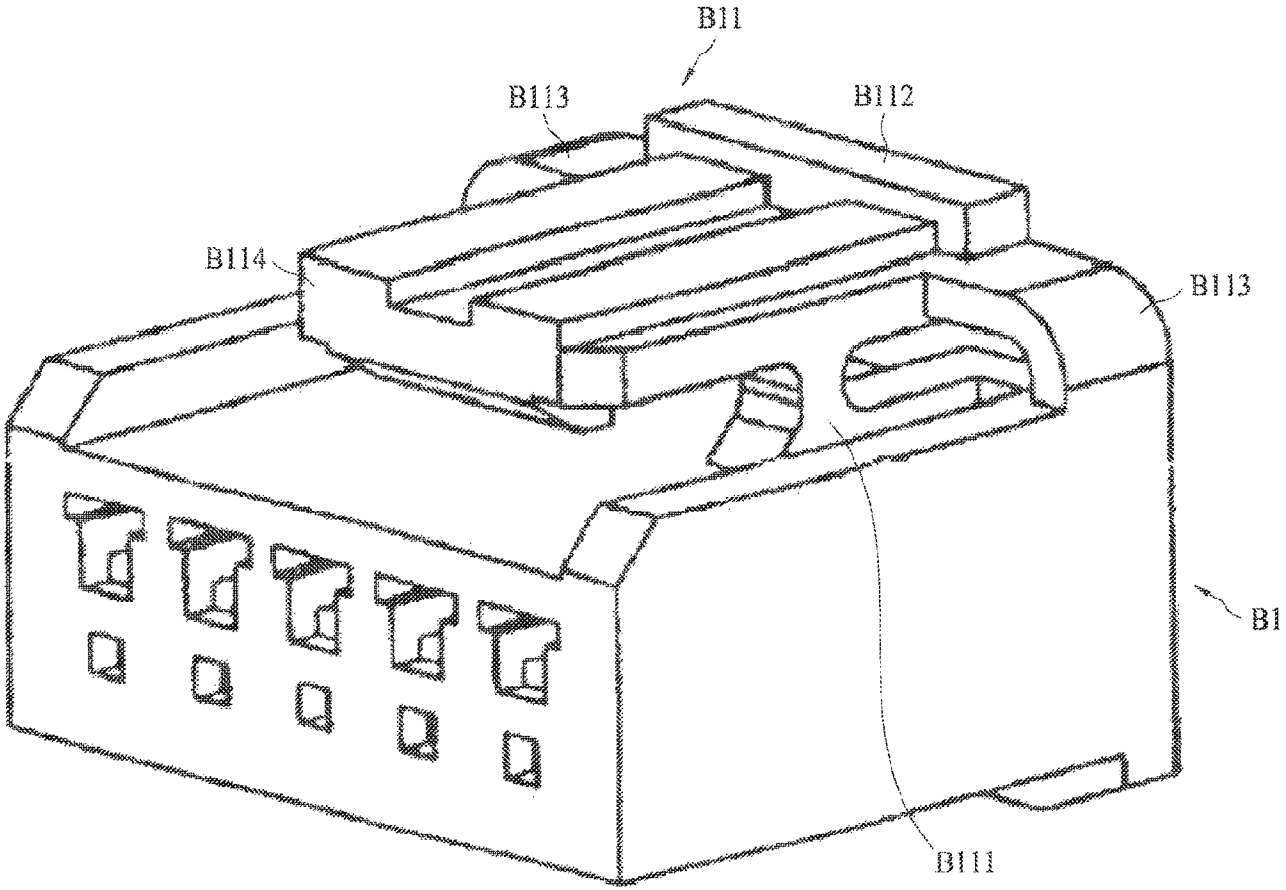
FIG. 6 Prior Art
FIG. 6 is a structural schematic view illustrating an insulative housing and a lock assembly of the power connector set of FIG. 5.
Figure 7:
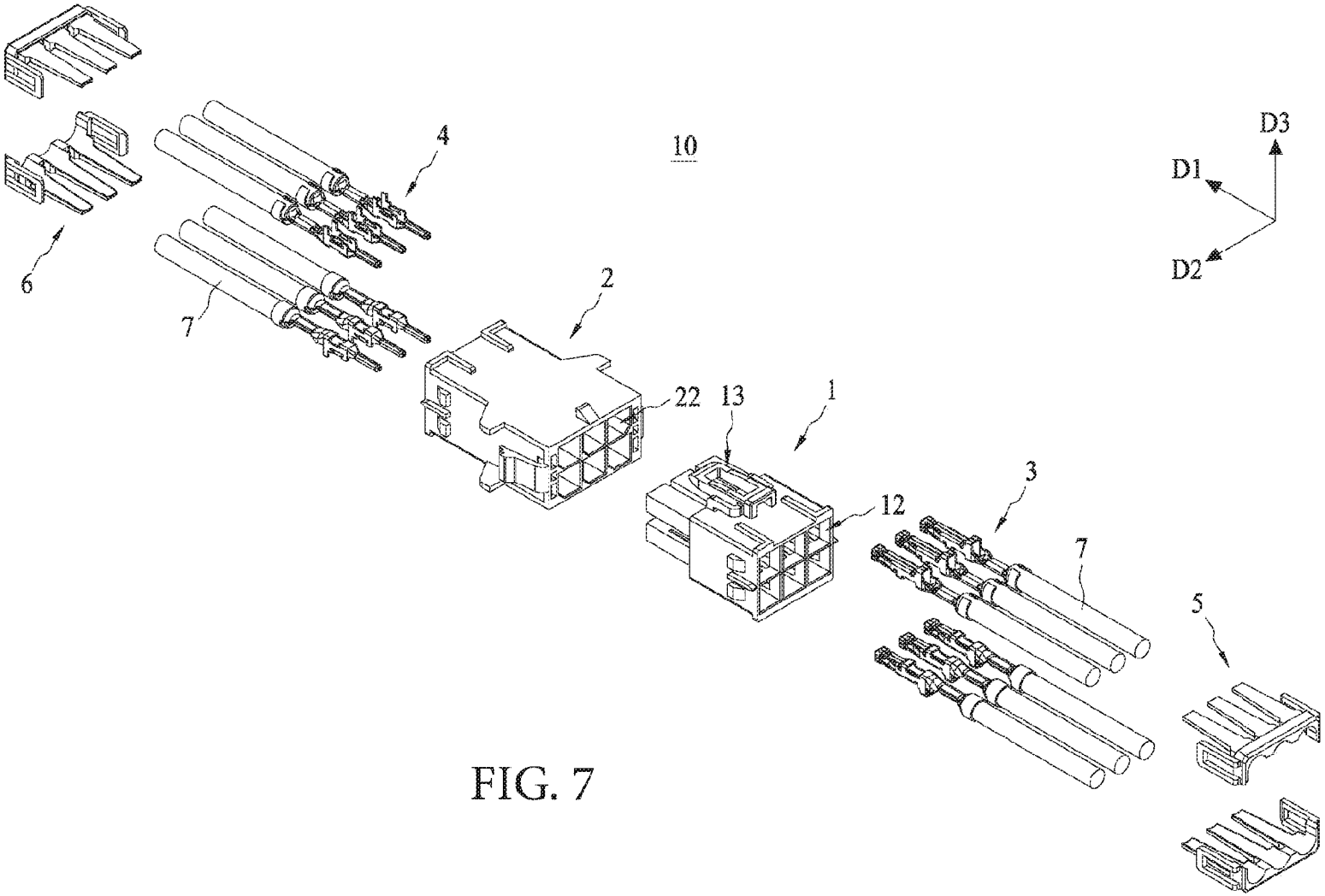
FIG. 7 is an exploded perspective schematic view illustrating a power connector set of an embodiment according to the present disclosure.
Figure 8:
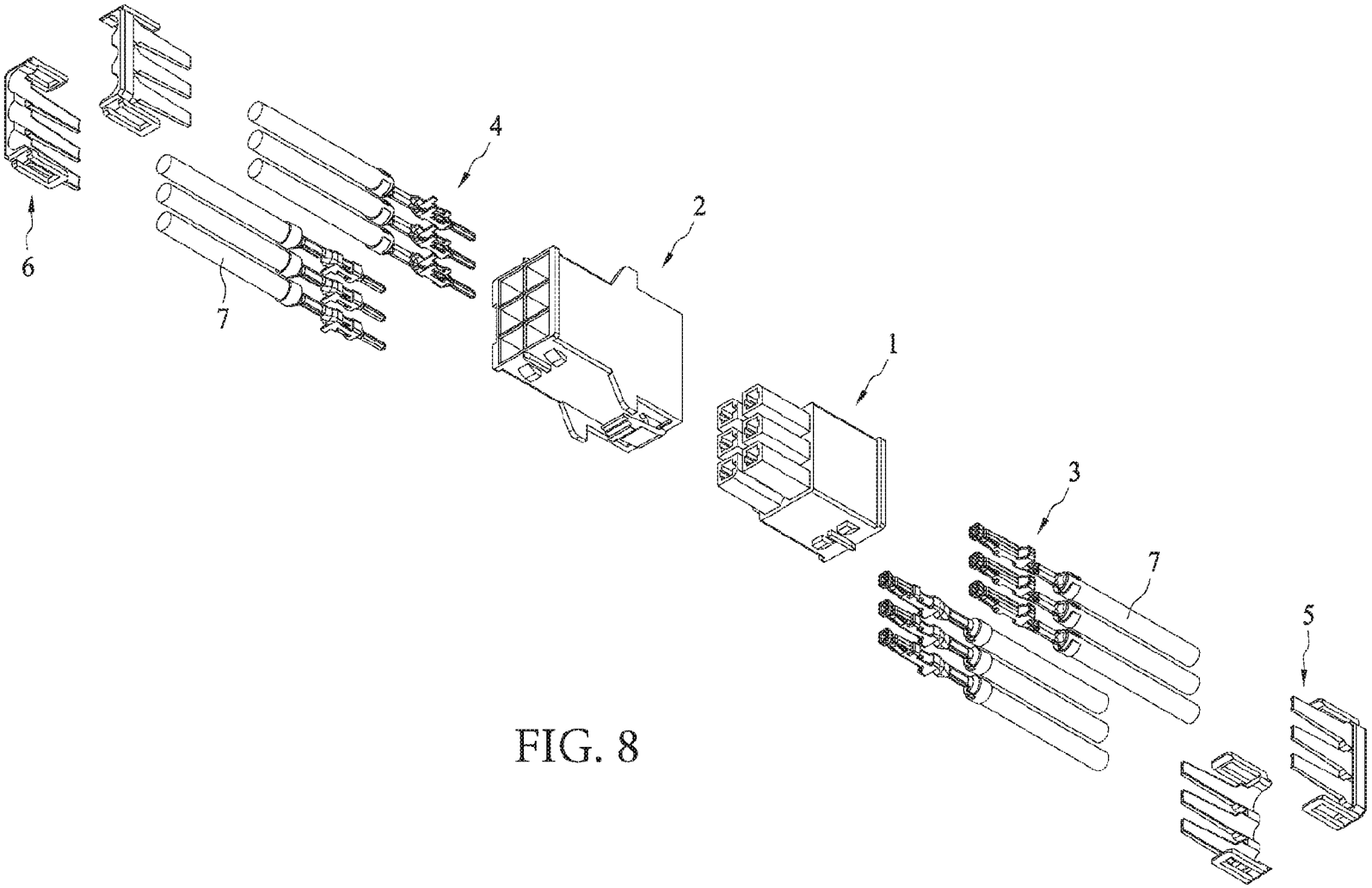
FIG. 8 is an exploded perspective schematic view illustrating the power connector set of FIG. 7 viewed from another angle.
Figure 9:
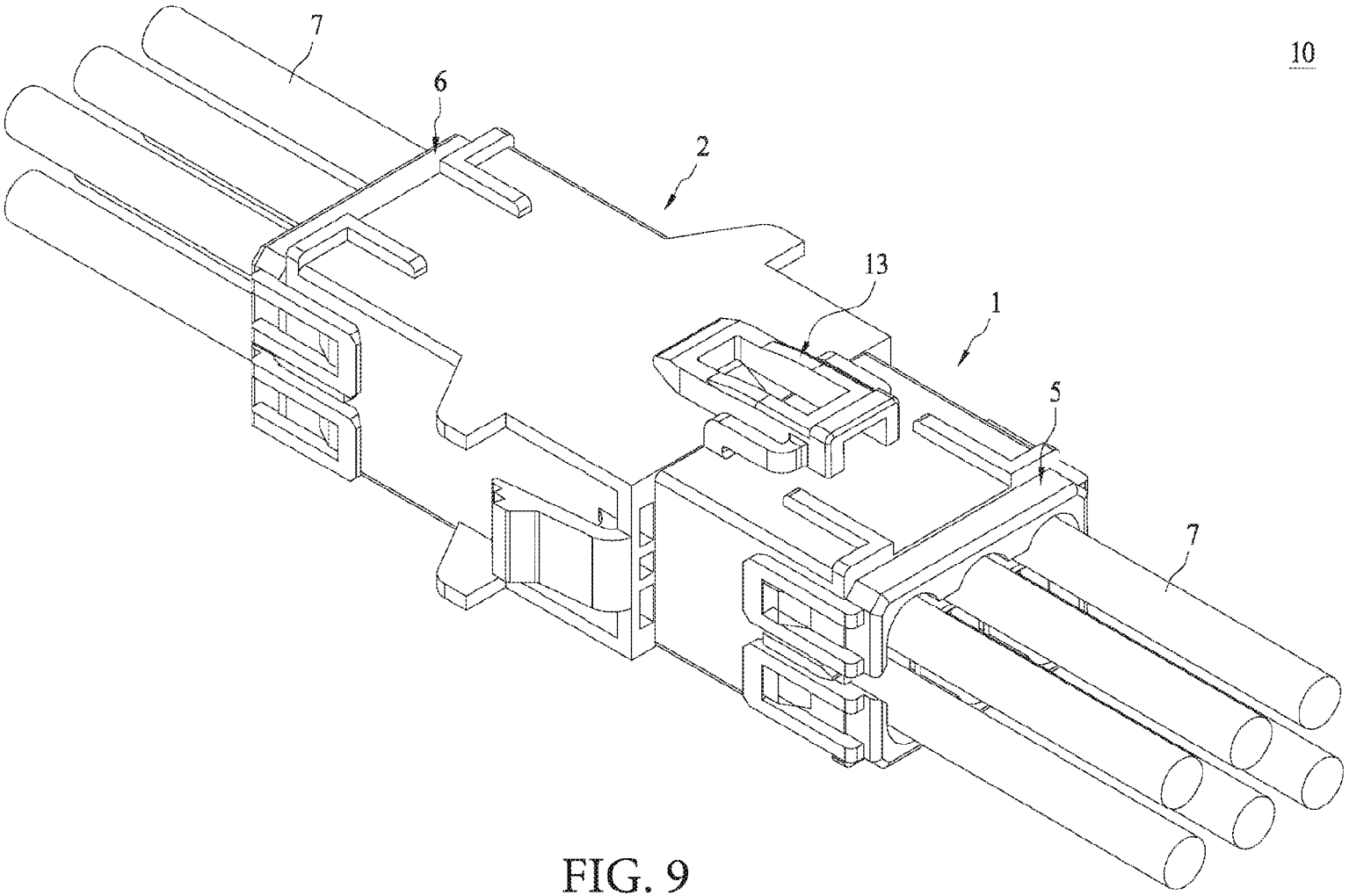
FIG. 9 is an assembled perspective schematic view illustrating the power connector set of FIG. 7.
Figure 10:
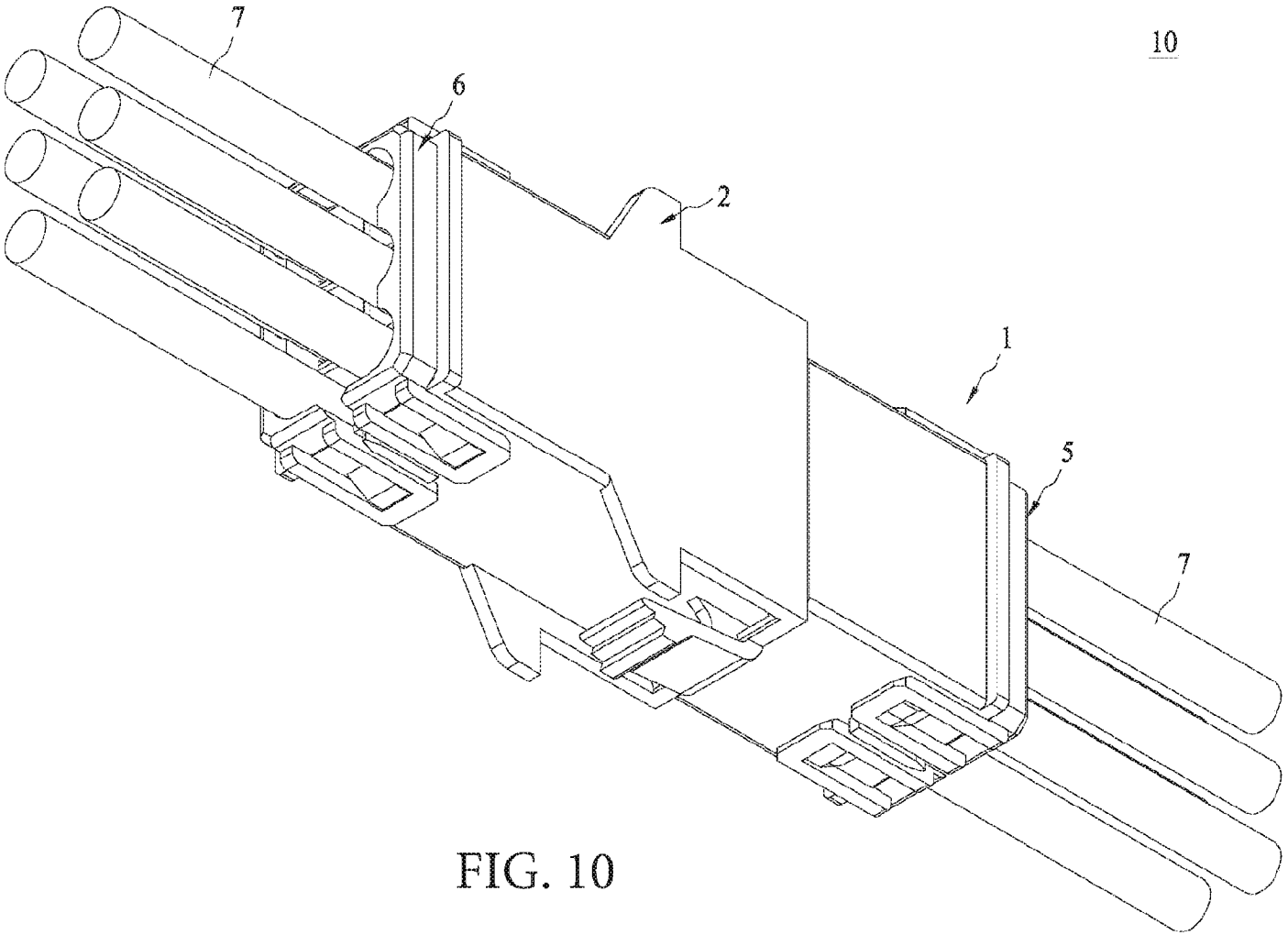
FIG. 10 is a assembled perspective schematic view illustrating the power connector set of FIG. 7 viewed from another angle.

FIG. 7 is an exploded perspective schematic view illustrating a power connector set 10 of an embodiment according to the present disclosure. FIG. 8 is an exploded perspective schematic view illustrating the power connector set 10 of FIG. 7 viewed from another angle. FIG. 9 is an assembled perspective schematic view illustrating the power connector set 10 of FIG. 7. FIG. 10 is a assembled perspective schematic view illustrating the power connector set 10 of FIG. 7 viewed from another angle. Referring to FIG. 7 to FIG. 10, a power connector set 10 comprises a first insulative housing 1, a lock assembly 13, a second insulative housing 2, a plurality of terminals 3, a plurality of terminals 4, a plurality of wires 7, a plurality of terminal fixing portions 5 and a plurality of terminal fixing portions 6. The first insulative housing 1, the lock assembly 13, the plurality of terminals 3 and the plurality of terminal fixing portions 5 form a part of a receptacle connector. The second insulative housing 2, the plurality of terminals 4 and the plurality of terminal fixing portions 6 form a part of a plug connector. It should be noted that when features of the present disclosure are described, embodiments used herein may be the plug connector or the receptacle connector, but each feature may be applied to the plug connector and the receptacle connector as desired.

In the present disclosure, each component of the power connector set 10, such as the terminal 3 and the terminal 4, may be multiple in number, but for convenience of explanation, each component will be described as a single element when appropriate. The first insulative housing 1 and the second insulative housing 2 respectively have a plurality of terminal receiving grooves 12 and a plurality of terminal receiving grooves 22. The terminal receiving grooves 12 and the terminal receiving grooves 22 are used to respectively receive the terminals 3 and the terminals 4. More specifically, taking the terminals 3 as an example, the terminals 3 are respectively received in the terminal receiving grooves 22 in a front-rear direction D1.

Figure 11:
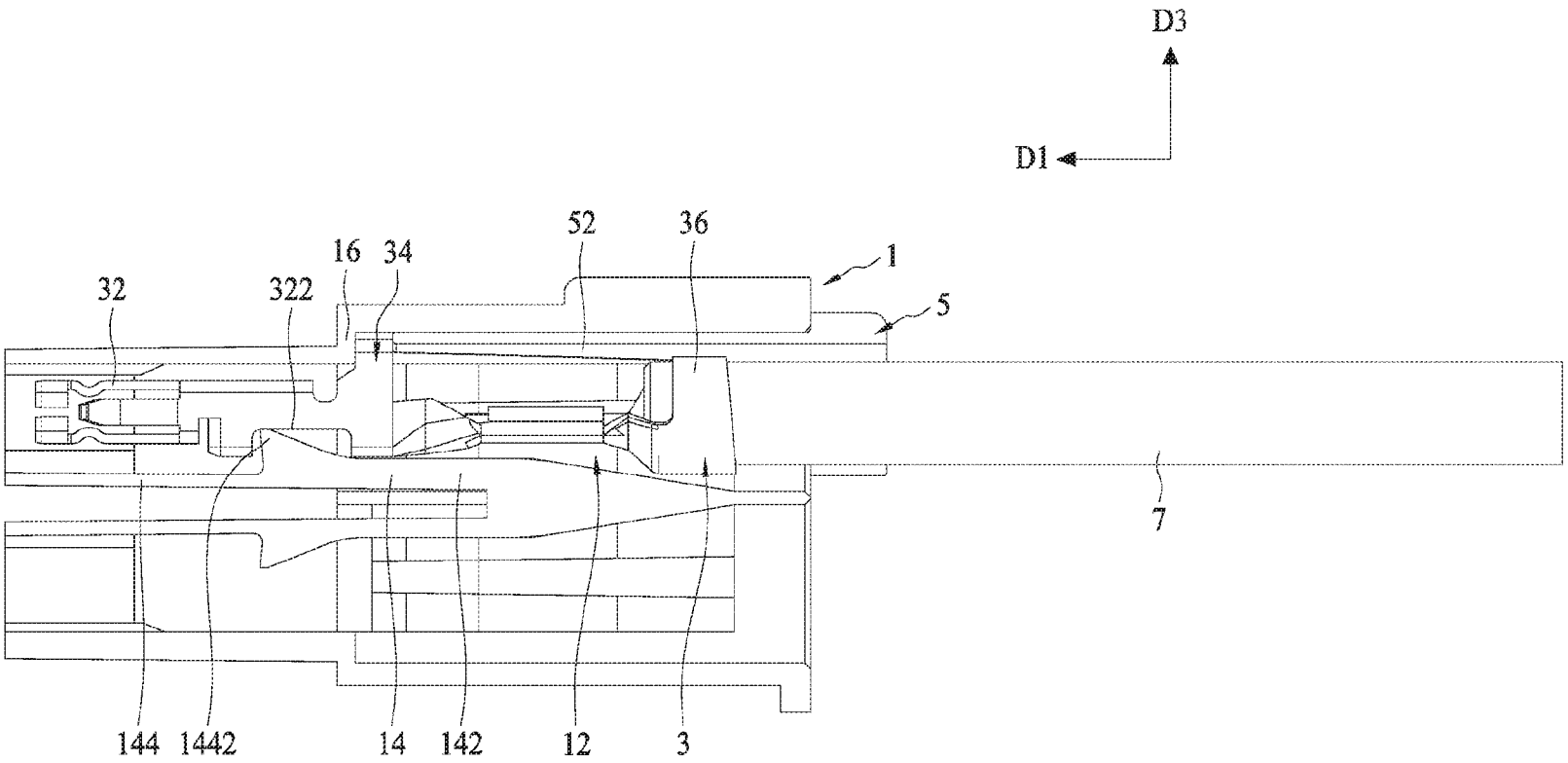
FIG. 11 is a cross-sectional plan schematic view illustrating a part of the power connector set of FIG. 7.
Figure 12:
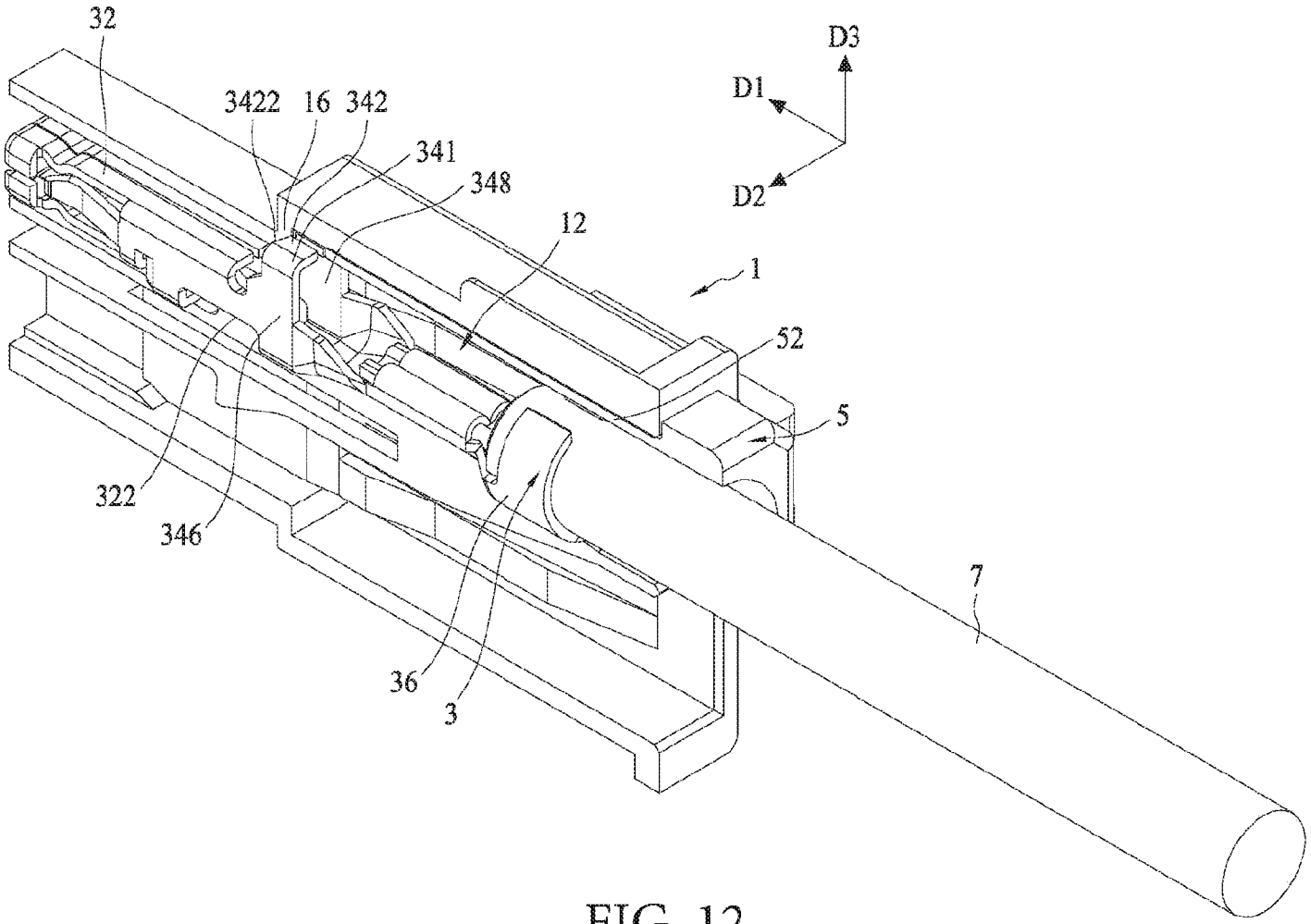
FIG. 12 is a cross-sectional perspective schematic view illustrating a part of the power connector set of FIG. 7.

FIG. 11 is a cross-sectional plan schematic view illustrating a part of the power connector set 10 of FIG. 7. FIG. 12 is a cross-sectional perspective schematic view illustrating a part of the power connector set 10 of FIG. 7. Referring to FIG. 11 and FIG. 12, the first insulative housing 1 comprises a stopping wall 16 and an elastic arm 14. The stopping wall 16 is used to stop the terminal 3, which will be described in detail below. The elastic arm 14 is positioned in the terminal receiving groove 12 of the first insulative housing 1. The elastic arm 14 comprises a first end 142, a second end 144 and an engaging protrusion 1442, the engaging protrusion 1442 is formed between the first end 142 and the second end 144, and protrudes into the terminal receiving groove 12, so as to be latched with an engaging opening 322 of the terminal 3. In an embodiment, both the first end 142 and the second end 144 are connected to the first insulative housing 1. In another embodiment, the first end 142 is connected to the first insulative housing 1, the second end 144 is a free end which is not connected to the first insulative housing 1 but extends into the terminal receiving groove so as to make the elastic arm 14 form a cantilever beam.

The terminal 3 comprises a mating portion 32, a stopping portion 34, a wire connecting portion 36. The mating portion 32, the stopping portion 34 and the wire connecting portion 36 are arranged in the front-rear direction D1 and sequentially connected. The mating portion 32 defines an engaging opening 322 therein, and the engaging opening 322 and the engaging protrusion 1442 of the first insulative housing 1 are latched with each other. The terminal fixing portion 5 comprises a fixing sheet body 52. The stopping portion 34 of the terminal 3 is supported by a front end of the fixing sheet body 52 to abut against and be fixed to the stopping wall 16 of the first insulative housing 1, so that the terminal 3 is stopped in the first insulative housing 1.

In the present disclosure, if the state of the terminal is not particularly specified, the state of the terminal will be "clamping wire state". More specifically, the "clamping wire state" refers to a state that the wire connecting portion 36 of the terminal 3 has been subjected to the bending and wire pressing process to clamp the wire 7.

Figure 13:
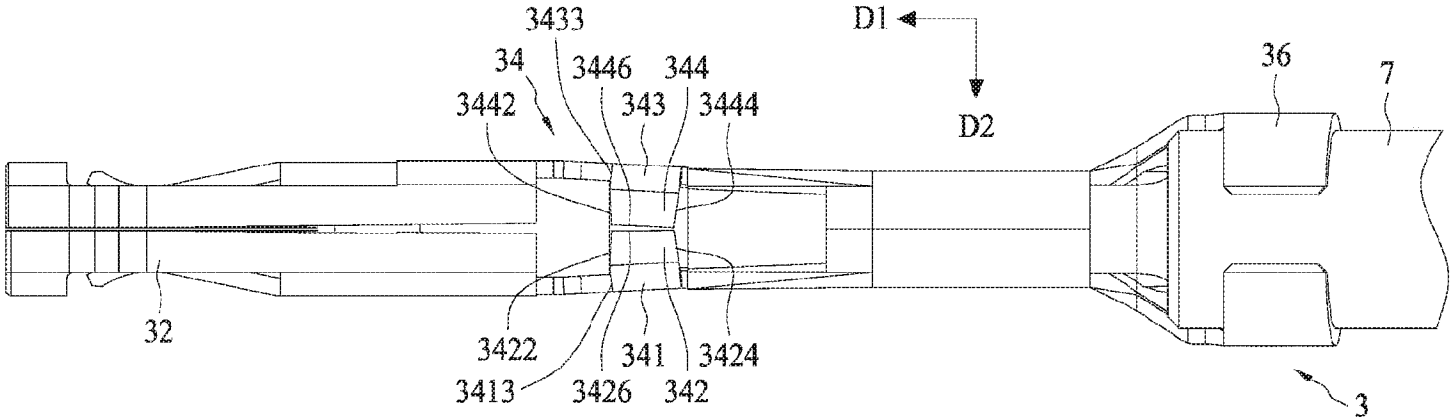
FIG. 13 is a schematic view illustrating a terminal of FIG. 7 after clamping a wire.
Figure 14:
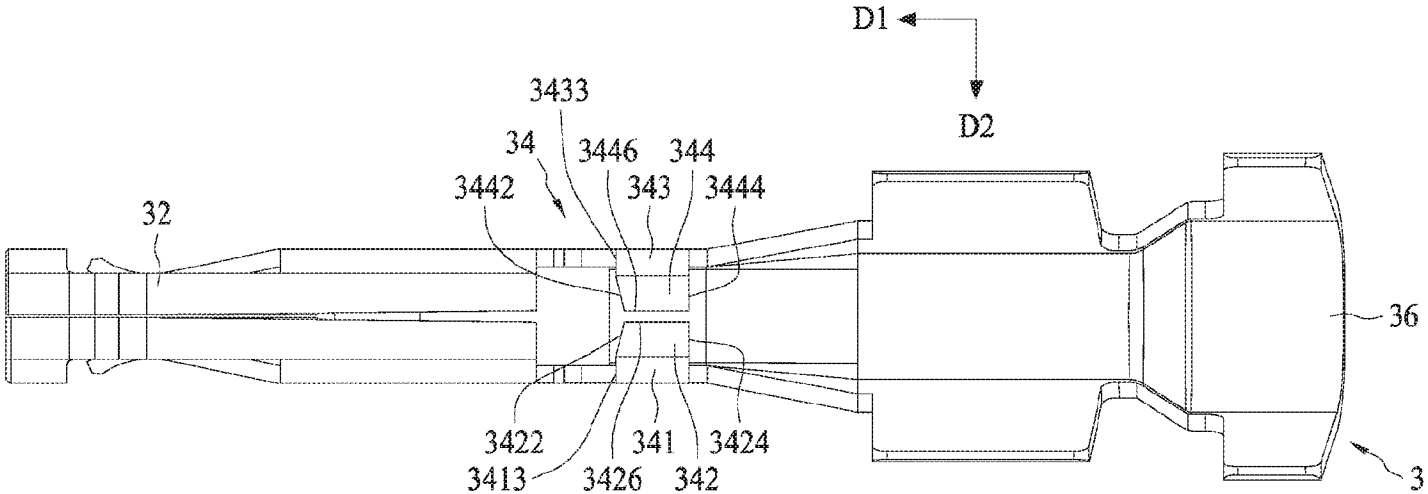
FIG. 14 is a schematic view illustrating the terminal of FIG. 7 before clamping the wire.

FIG. 13 is a schematic view illustrating a terminal of FIG. 7 after clamping a wire. FIG. 14 is a schematic view illustrating the terminal of FIG. 7 before clamping the wire. Referring to FIG. 13, the stopping portion 34 comprises a first horizontal portion 342 and a second horizontal portion 344 facing each other, a first vertical portion 346 (referring to FIG. 12) and a second vertical portion 348 (referring to FIG. 12) facing each other, and a first bent portion 341 and a second bent portion 343 facing each other.

The first horizontal portion 342 is perpendicular to the first vertical portion 346, and connected to the first vertical portion 346 via the first bent portion 341. Similarly, the second horizontal portion 344 is perpendicular to the second vertical portion 348, and connected to the second vertical portion 348 via the second bent portion 343. In an embodiment, the first bent portion 341 and the second bent portion 343 each have a radian.

The first horizontal portion 342 comprises a first front end edge 3422, a first rear end edge 3424 and a first free end edge 3426. The first free end edge 3426 generally extends in the front-rear direction D1 to connect the first front end edge 3422 and the first rear end edge 3424 which are opposite to each other and positioned in the front-rear direction D1. Similarly, the second horizontal portion 344 comprises a second front end edge 3442, a second rear end edge 3444 and a second free end edge 3446. The second free end edge 3446 generally extends in the front-rear direction D1 to connect the second front end edge 3442 and the second rear end edge 3444 which are opposite to each other and positioned in the front-rear direction D1.

In the present disclosure, the term "front" refers to the front side in the front-rear direction D1, and the term "rear" refers to the rear side in the front-rear direction D1. For example, the first front end edge 3422 is close to the front side in the front-rear direction D1 relative to the rear side in the front-rear direction D1.

As shown in FIG. 13, after the terminal 3 clamps the wire, the wire connecting portion 36 bends and squeezes the stopping portion 34 by the bending and wire pressing process to make the first vertical portion 346 and the second vertical portion 348 splay forwardly and outwardly due to squeezing, thereby resulting in that a distance between the first vertical portion 346 and the second vertical portion 348 in a left-right direction D2 becomes gradually narrower backwardly, and thereby pushing the first horizontal portion 342 and the second horizontal portion 344 forwardly. At this time, the first rear end edge 3424 and the second rear end edge 3444 of the stopping portion 34 respectively extend forwardly, a distance between the first free end edge 3426 and the second free end edge 3446 becomes gradually narrower backwardly. However, the first front end edge 3422 and the second front end edge 3442 do not splay forwardly and outwardly to protrude forwardly, but extend parallel to each other or respectively extend backwardly.

When the terminal 3 is assembled with the first insulative housing 1 (referring to FIG. 11 and FIG. 12), because of the design of the stopping portion 34, which will be shown in FIG. 14 in detail, after the terminal 3 clamps the wire, the first front end edge 3422 of the first horizontal portion 342 and the second front end edge 3442 of the second horizontal portion 344 of the terminal 3 can extend parallel to each other (referring to FIG. 15) or respectively extend backwardly (referring to FIG. 13), so that the first front end edge 3422 and the second front end edge 3442 of the terminal 3 would protrude forwardly and abut against the stopping wall 16 first as in the prior art will not occur in the present disclosure, and the terminal 3 can be mounted to the correct position. In another embodiment, the first front end edge 3422 of the first horizontal portion 342 and the second front end edge 3442 of the second horizontal portion 344 of the terminal 3 do not protrude forwardly beyond front end edges of the first vertical portion 346 and the second vertical portion 348, and when the first front end edge 3422 and second front end edge 3442 respectively extend backwardly, the front end edges of the first vertical portion 346 and the second vertical portion 348 and/or front end edges 3413, 3433 of the first bent portion 341 and the second bent portion 343 abut against the stopping wall 16.

Referring to FIG. 14, the wire connecting portion 36 of the terminal 3 is in an opened state without the bending and wire pressing process for clamping the wire, at this time the stopping portion 34 is not squeezed forwardly without the bending and wire pressing process. The first front end edge 3422 and the second front end edge 3442 of the stopping portion 34 do not extend respectively along the front end edge 3413 of the first bent portion 341 and the front end edge 3433 of the second bent portion 343, thus the first front end edge 3422 and the second front end edge 3442 are not parallel to each other. Definitely, the first front end edge 3422 and the second front end edge 3442 respectively extend backwardly toward each other; therefore, when the terminal 3 clamps the wire, the first front end edge 3422 and the second front end edge 3442 do not splay forwardly and outwardly to protrude forwardly, but extend parallel to each other or respectively extend backwardly, which can avoid the first front end edge 3422 and the second front end edge 3442 of the stopping portion 34 of the terminal 3 from abutting against the stopping wall 16 of the first insulative housing 1 first if the first front end edge 3422 and the second front end edge 3442 protrude forwardly. Therefore, the terminal 3 of the present disclosure can be mounted to the correct position in the first insulative housing 1. In an embodiment, the first front end edge 3422 and the second front end edge 3442 are formed by respectively cutting off a portion of a front end of the first horizontal portion 342 and a portion of a front end of the second horizontal portion 344.

Figure 15:
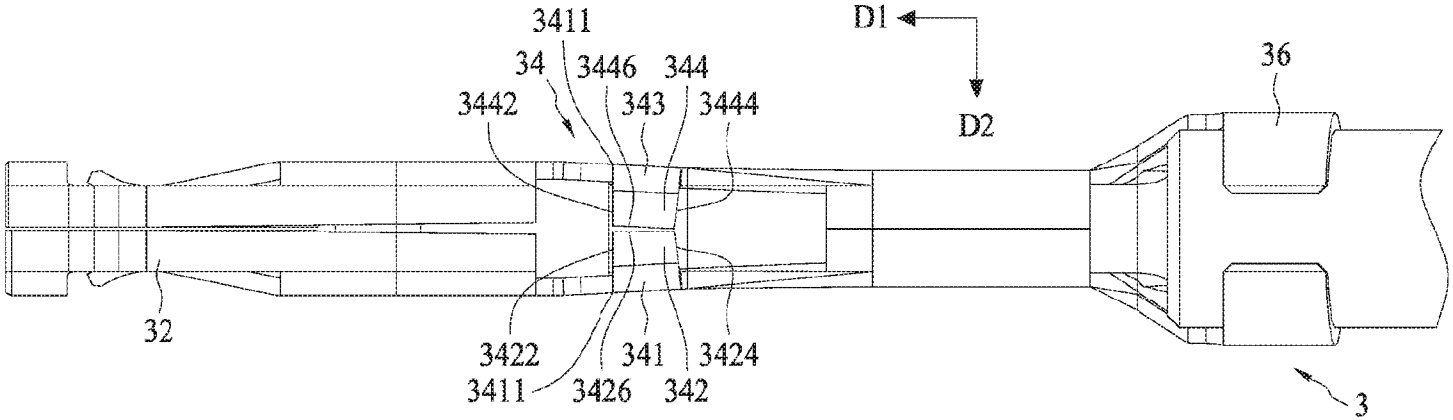
FIG. 15 is a schematic view illustrating a terminal of another embodiment according to the present disclosure after clamping the wire.
Figure 16:
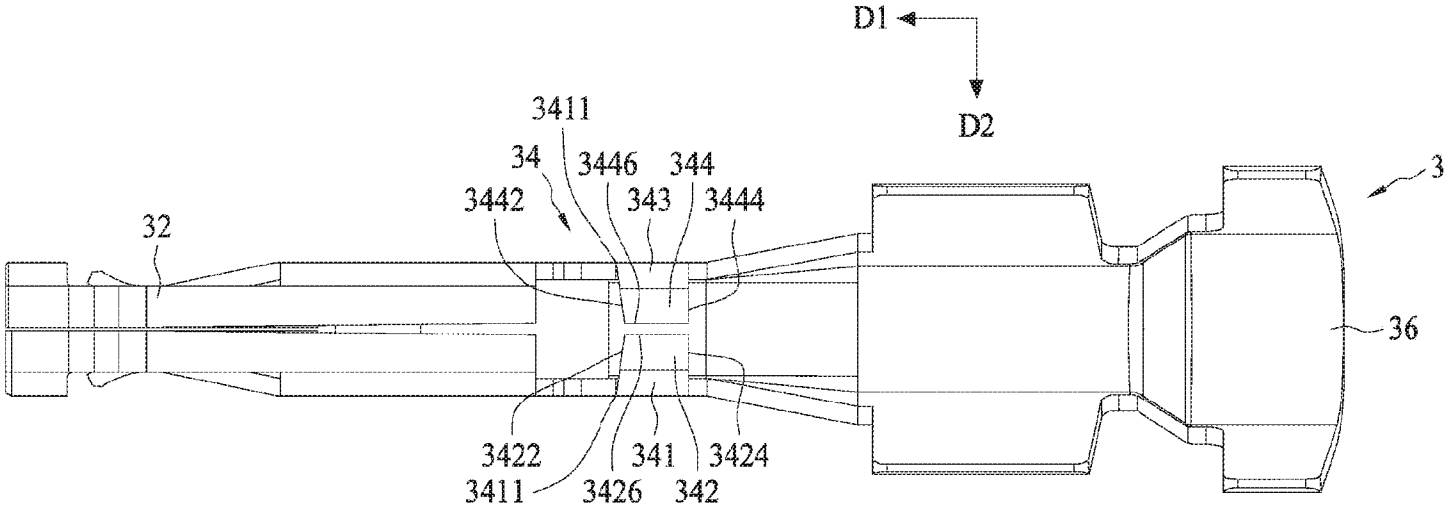
FIG. 16 is a schematic view illustrating the terminal of FIG. 15 before clamping the wire.

FIG. 15 is a schematic view illustrating a terminal 3 of another embodiment according to the present disclosure after clamping the wire. FIG. 16 is a schematic view illustrating the terminal 3 of FIG. 15 before clamping the wire. Referring to FIG. 15 and FIG. 16, the stopping portion 34 of the terminal 3 is similar to the stopping portion 34 shown in FIG. 13 and FIG. 14, but is different in that a portion of the first horizontal portion 342 and a portion of the second horizontal portion 344, and a portion of the first bent portion 341 and a portion of the second bent portion 343 of the stopping portion 34 of FIG. 15 and FIG. 16 are cut off More specifically, the left and right cut-off portions start from left and right root portions 3411 of the front edges of the first bent portion 341 and the second bent portion 343 respectively, and extend backwardly toward each other. Compared to only cutting off a portion of the first horizontal portion 342 and a portion of the second horizontal portion 344, the embodiment can also more effectively avoid the first front end edge 3422 and the second front end edge 3442 from splaying forwardly and outwardly to protrude forwardly due to the bending and wire pressing process for the terminal 3 clamping the wire. As shown in FIG. 15, the first front end edge 3422 and the second front end edge 3442 of the stopping portion 34 are horizontal, and do not protrude forwardly. It should be noted that, although that a portion of the first bent portion 341 and a portion of the second bent portion 343 are cut off in the embodiment of FIG. 15 and FIG. 16 does not occur in the embodiment of FIG. 13 and FIG. 14, because these two portions are positioned at the left and right root portions 3411 of the stopping portion 34 in the embodiment of FIG. 13 and FIG. 14, an amount of deformation affected by these two portions when the terminal 3 clamps the wire is very little in the embodiment of FIG. 13 and FIG. 14, which does not affect the correct positioning of the terminal 3 in the first insulative housing 1 in the embodiment of FIG. 13 and FIG. 14.

Figure 17:
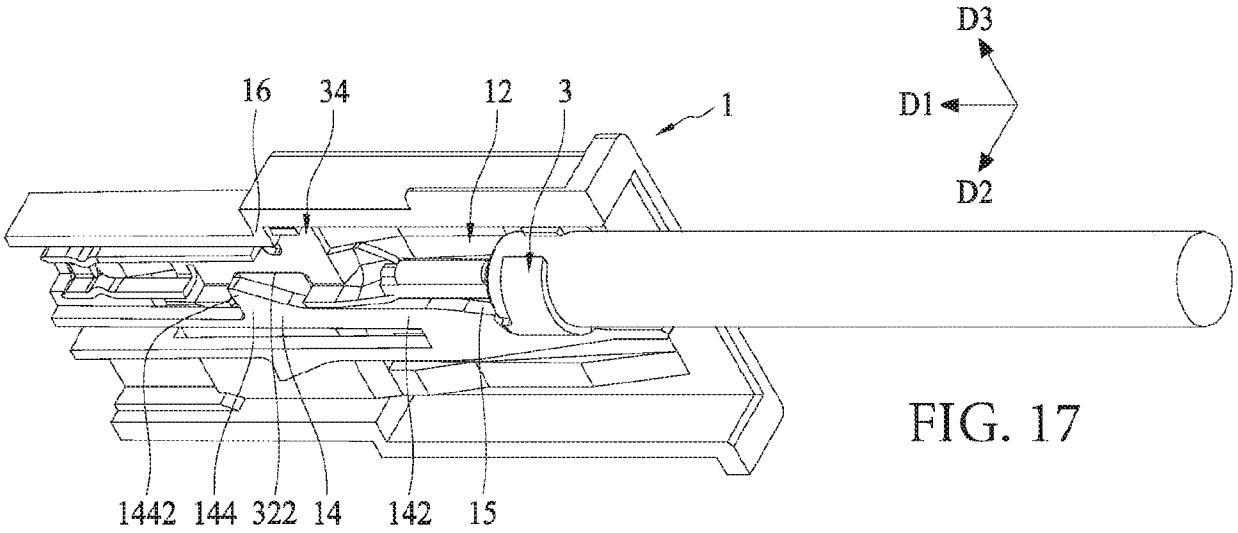
FIG. 17 is a cross-sectional schematic view illustrating that the terminal is assembled to a first insulative housing in a normal orientation.
Figure 18:
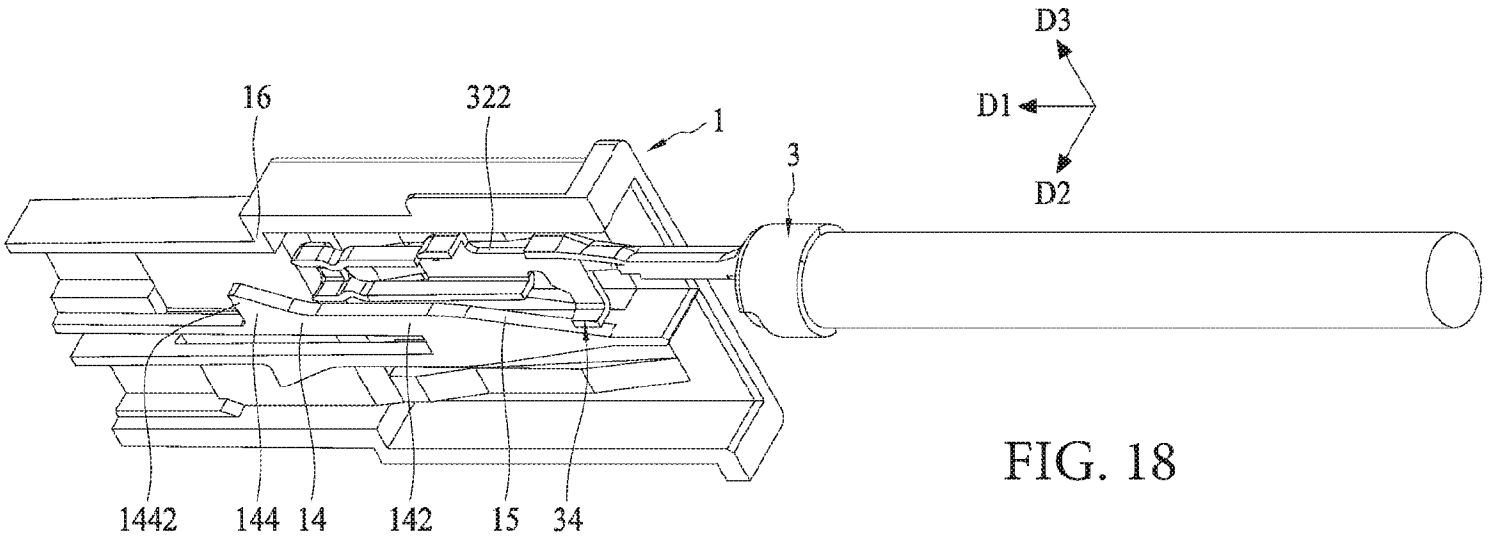
FIG. 18 is a cross-sectional schematic view illustrating that the terminal is assembled to the first insulative housing in a reverse orientation.

FIG. 17 is a cross-sectional schematic view illustrating that the terminal 3 is assembled to a first insulative housing 1 in a normal orientation. FIG. 18 is a cross-sectional schematic view illustrating that the terminal 3 is assembled to the first insulative housing 1 in a reverse orientation. Referring to FIG. 17, the first insulative housing 1 comprises a slope 15 positioned at a bottom portion of the terminal receiving groove 12 of the first insulative housing 1 in an up-down direction D3 relative to the stopping wall 16 and ascending from rear to front. When the terminal 3 is assembled in a normal orientation, the stopping portion 34 of the terminal 3 will not interfered with the slope 15, therefore the terminal 3 may be smoothly inserted into the terminal receiving groove 12. Referring to FIG. 18, when the terminal 3 is assembled to the first insulative housing 1 in a reverse orientation (that is, the terminal 3 is upside down relative to the normal orientation), the stopping portion 34 of the terminal 3 will interfere with the slope 15, which results in that the terminal 3 cannot be inserted into the terminal receiving groove 12. In the present disclosure, due to the cooperation between the slope 15 of the first insulative housing 1 and the stopping portion 34 of the terminal 3, it can ensure that the insertion with the deflection angle between the terminal 3 and the first insulative housing 1 relative to the normal orientation (such as 90 degree/180 degree/270 degree) except the normal angle (that is in the normal orientation) cannot allow the terminal 3 to be assembled to the first insulative housing 1.

Figure 19:
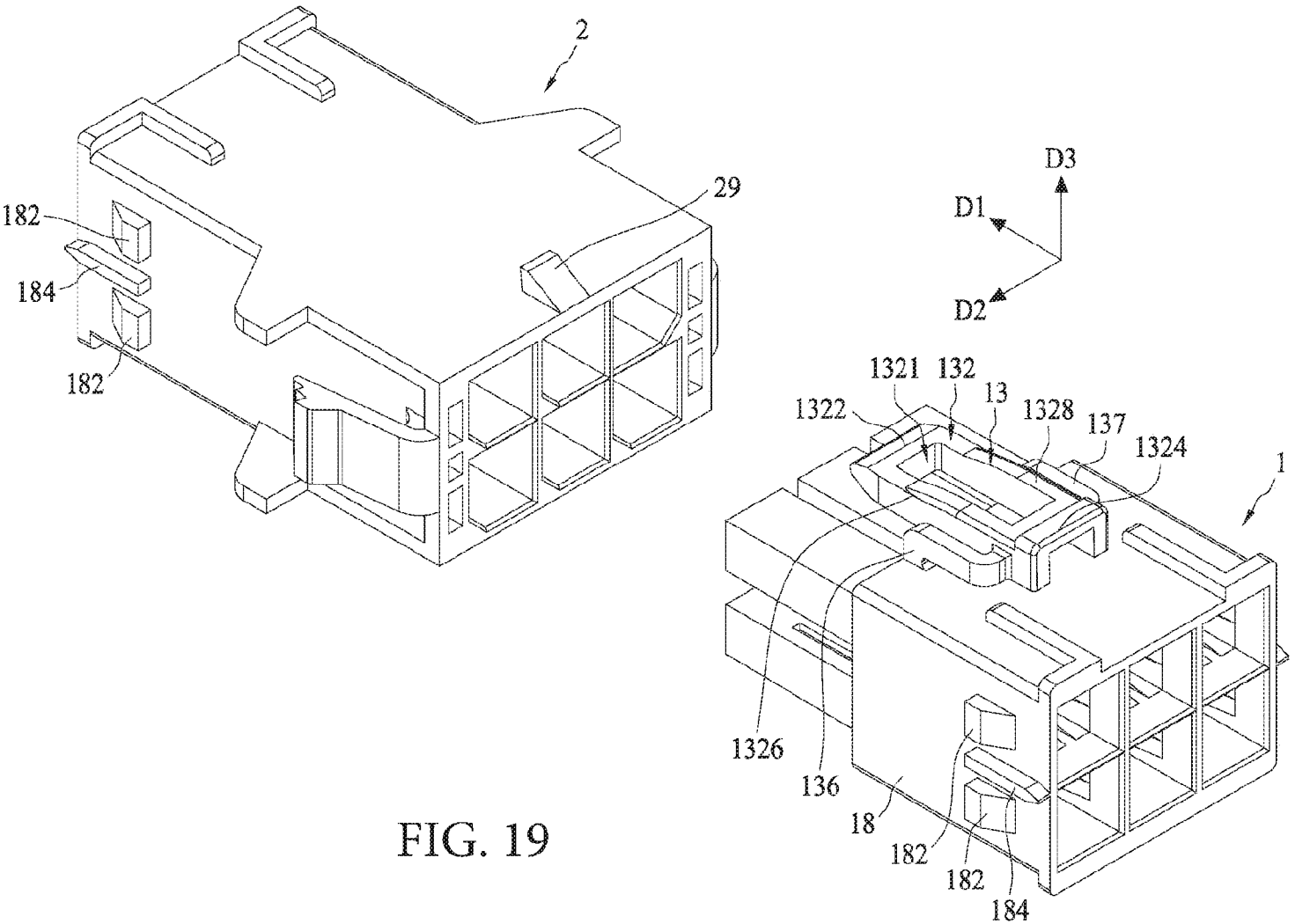
FIG. 19 is a perspective schematic view illustrating the first insulative housing and a second insulative housing of the power connector set of FIG. 7.
Figure 20:
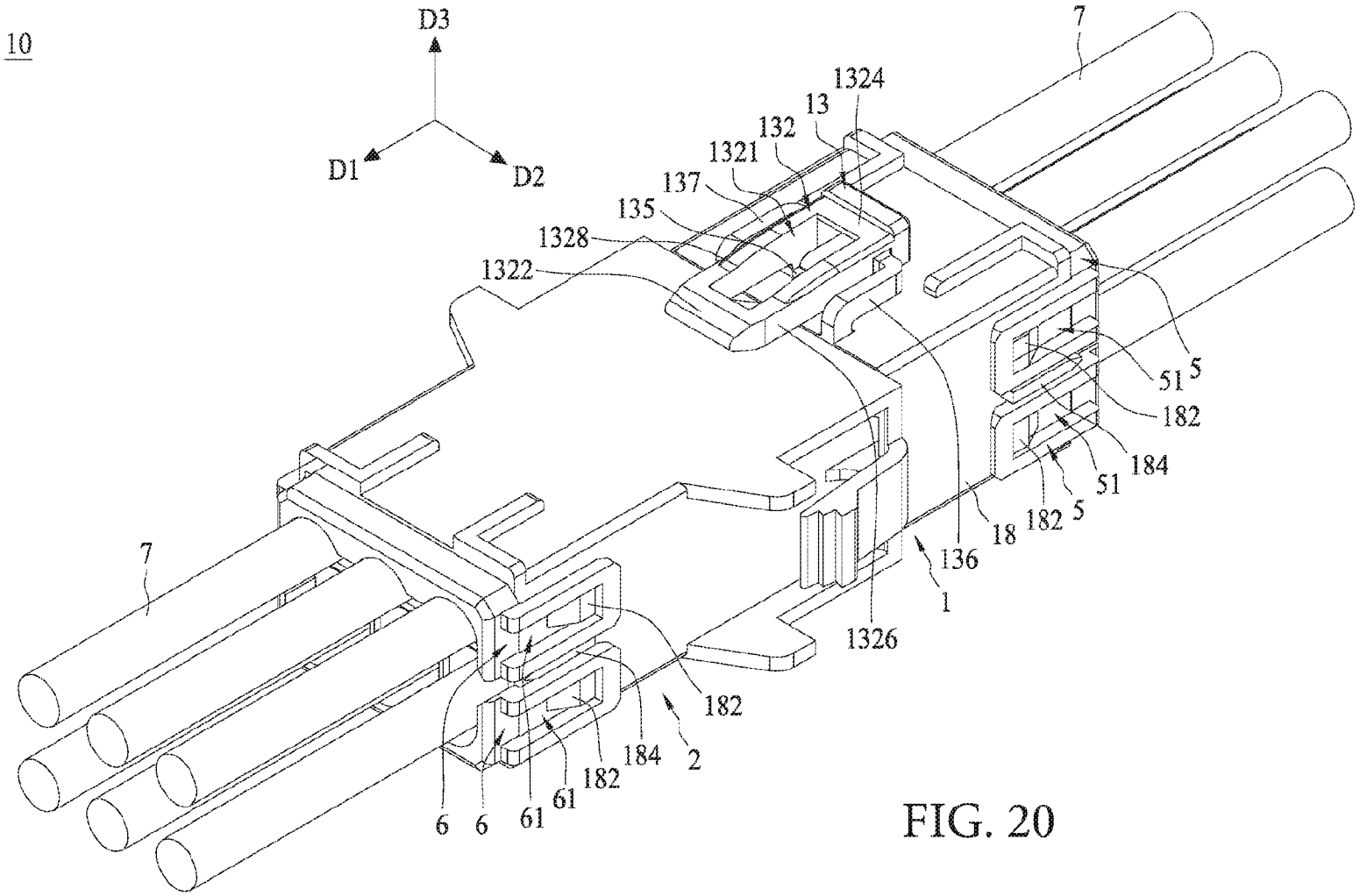
FIG. 20 is an assembled perspective schematic view illustrating the power connector set of FIG. 7.

FIG. 19 is a perspective schematic view illustrating the first insulative housing 1 and a second insulative housing 2 of the power connector set 10 of FIG. 7. The first insulative housing 1 may be an insulative housing of a receptacle connector, the second insulative housing 2 may be an insulative housing of a plug connector. FIG. 20 is an assembled perspective schematic view illustrating the power connector set 10 of FIG. 7. Referring to FIG. 19 and FIG. 20, the power connector set 10 comprises a lock assembly 13 provided to an upper surface of the first insulative housing 1. A protruding block 29 is provided to an upper surface of the second insulative housing 2. The first insulative housing 1 and the second insulative housing 2 are assembled with each other by that the lock assembly 13 the protruding block 29 are latched with each other.

The lock assembly 13 comprises a frame 132, a first leg 134 (referring to FIG. 21), a second leg 135, a first elastic arm 136 and a second elastic arm 137. The frame 132 defines an opening 1321 therein. The first insulative housing 1 and the second insulative housing 2 are assembled with each other by that the opening 132 of the frame 132 the protruding block 29 are latched with each other.

The frame 132 comprises a front bracket 1322, a rear bracket 1324, a first side bracket 1326 and a second side bracket 1328. The front bracket 1322, the rear bracket 1324, the first side bracket 1326, and the second side bracket 1328 form the opening 1321. The front bracket 1322 and the rear bracket 1324 face each other, are spaced apart from each other by the opening 1321 and are positioned in the front-rear direction D1. The front bracket 1322 connects a front end of the first side bracket 1326 and a front end of the second side bracket 1328. The rear bracket 1324 connects a rear end of the first side bracket 1326 and a rear end of the second side bracket 1328. The first side bracket 1326 and the second side bracket 1328 face each other, are spaced apart from each other by the opening 1321 and are positioned in the left-right direction D2.

The first leg 134 of the lock assembly 13 (referring to FIG. 21) is positioned between the front bracket 1322 and the rear bracket 1324 of the frame 132, and extends from the first side bracket 1326 of the frame 132 to the upper surface of the first insulative housing 1 in the up-down direction D3 and connects with the upper surface of the first insulative housing 1. The second leg 135 of the lock assembly 13 is positioned between the front bracket 1322 and the rear bracket 1324 of the frame 132, and extends from the second side bracket 1328 of the frame 132 to the upper surface of the first insulative housing 1 in the up-down direction D3 and connects with the upper surface of the first insulative housing 1.

The first elastic arm 136 of the lock assembly 13 extends outwardly from a left end of the rear bracket 1324 of the frame 132 in the left-right direction D2 by a certain distance, and then extends forwardly in the front-rear direction D1 by a certain distance, and then extends to the upper surface of the first insulative housing 1 in the up-down direction D3 and connects with the upper surface of the first insulative housing 1. The second elastic arm 137 of the lock assembly 13 extends outwardly from a right end of the rear bracket 1324 of the frame 132 in the left-right direction D2 by a certain distance, and then extends forwardly in the front-rear direction D1 by a certain distance, and then extends to the upper surface of the first insulative housing 1 in the up-down direction D3 and connects with the upper surface of the first insulative housing 1.

The present disclosure increases the mechanical strength of the lock assembly 13 through the first elastic arm 136 and the second elastic arm 137. Different from the prior art, the first elastic arm 136 and the second elastic arm 137 do not extend outwardly respectively from the left and right ends of the rear bracket 1324 of the lock assembly 13 and then directly connect downwardly with the first insulative housing 1, but the first elastic arm 136 and the second elastic arm 137 extend outwardly respectively from the left and right ends of the rear bracket 1324 of the lock assembly 13, then firstly extend forwardly by a certain distance, and then connects downwardly with the first insulative housing 1. This design can increase the flexibility of the lock assembly 13 and avoid the problem that the pressing handle B112 of the lock assembly B11 in the prior art is difficult to press down. That is, the present disclosure makes it easier to assemble or disassemble the first insulative housing 1 and the second insulative housing 2.

In addition, two latching blocks 182 arranged in the up-down direction D3 are provided to each of left and right side walls 18 of the first insulative housing 1, a guiding rib 184 extending in the front-rear direction D1 is provided between the two latching blocks 182. The terminal fixing portion 5 has an opening 51. When the terminal fixing portion 5 is assembled with the first insulative housing 1, the terminal fixing portion 5 is guided by the guiding rib 184, so as to allow the opening 51 of the terminal fixing portion 5 to be latched with the latching block 182 of the first insulative housing 1, at the same time the terminal fixing portion 5 fixes the assembled terminal 3 and first insulative housing 1 through the fixing sheet body 52 (referring to the above description of FIG. 11). Similarly, two latching blocks 182 arranged in the up-down direction D3 are provided to each of left and right side walls of the second insulative housing 2, a guiding rib 184 extending in the front-rear direction D1 is provided between the two latching blocks 182.

The assembling of the terminal fixing portion 6 and the second insulative housing 2 is similar to the assembling of the terminal fixing portion 5 and the first insulative housing 1. The terminal fixing portion 6 has an opening 61. When the terminal fixing portion 6 is assembled with the second insulative housing 2, the terminal fixing portion 6 is guided by the guiding rib 184, so as to allow the opening 61 to be latched with the latching block 182. In addition, although the fixing sheet body of the terminal fixing portion 6 is not shown in FIG. 24, the terminal fixing portion 6 also fixes the assembled terminal 4 and second insulative housing 2 through the fixing sheet body of the terminal fixing portion 6. In the present disclosure, due to the cooperation between the latching block 182 and the guiding rib 184, the present disclosure may avoid the problem of misalignment of the assembling of the terminal fixing portion 5, 6 and the insulative housing 1, 2.

Figure 21:
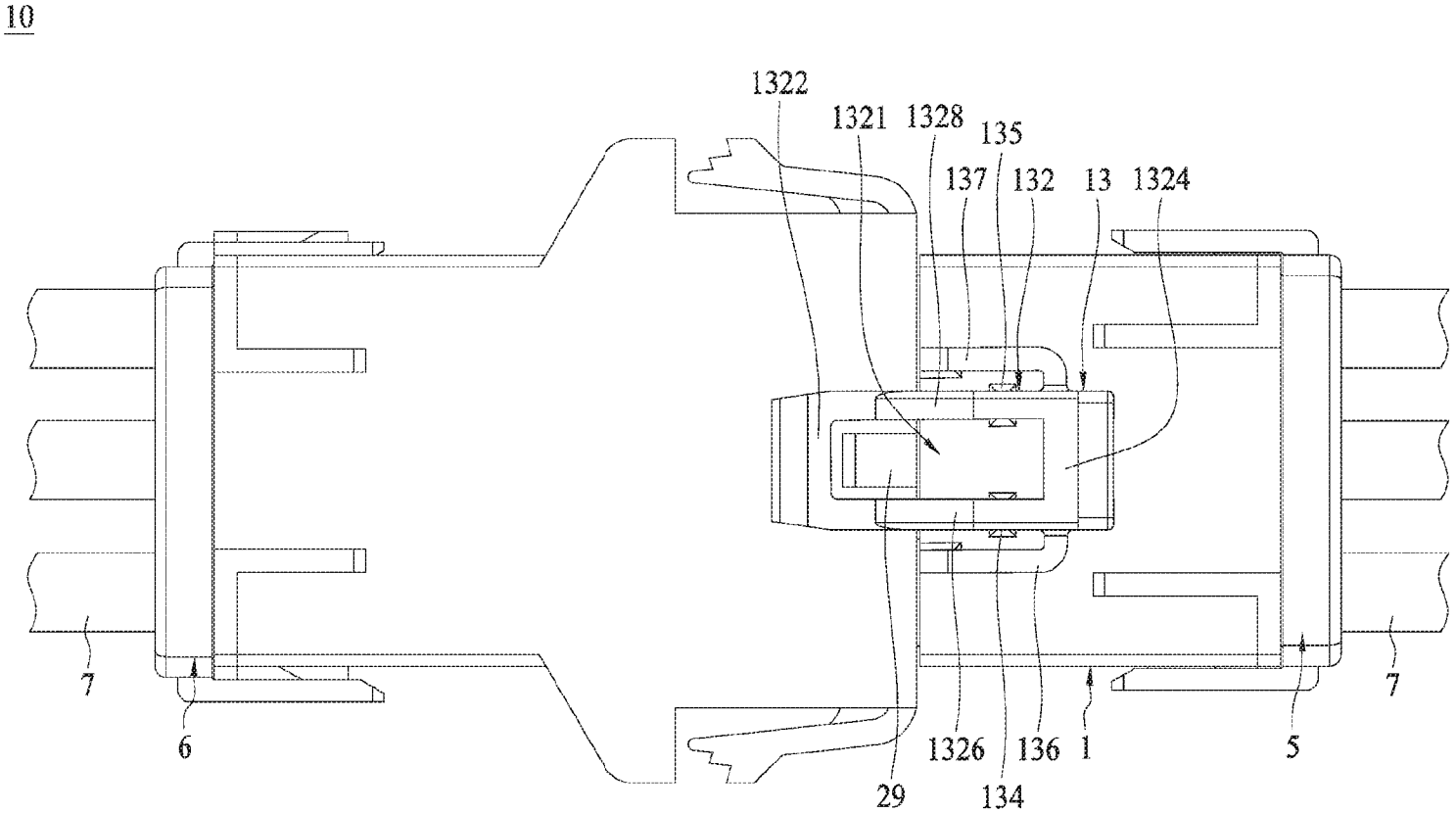
FIG. 21 is a top schematic view illustrating the power connector set of FIG. 9.

FIG. 21 is a top schematic view illustrating the power connector set 10 of FIG. 9. Referring to FIG. 21, the opening 1321 of the frame 132 occupies a relatively large area of the frame 132 in the up-down direction. In addition, the front bracket 1322, the rear bracket 1324, the first side bracket 1326, and the second side bracket 1328 of the frame 132 are thin cylinders. Accordingly, this design can avoid the sink mark deformation due to an uneven wall thickness of the mold injection in manufacturing of the frame 132. The lock member in the prior art is a thick solid block (for example the latch arm B114) or has a small opening, because the wall thickness is too thick, uneven filling occurs during injection molding and the uneven filling together with subsequent thermal expansion and contraction easily make the lock member deformed.

Figure 22:
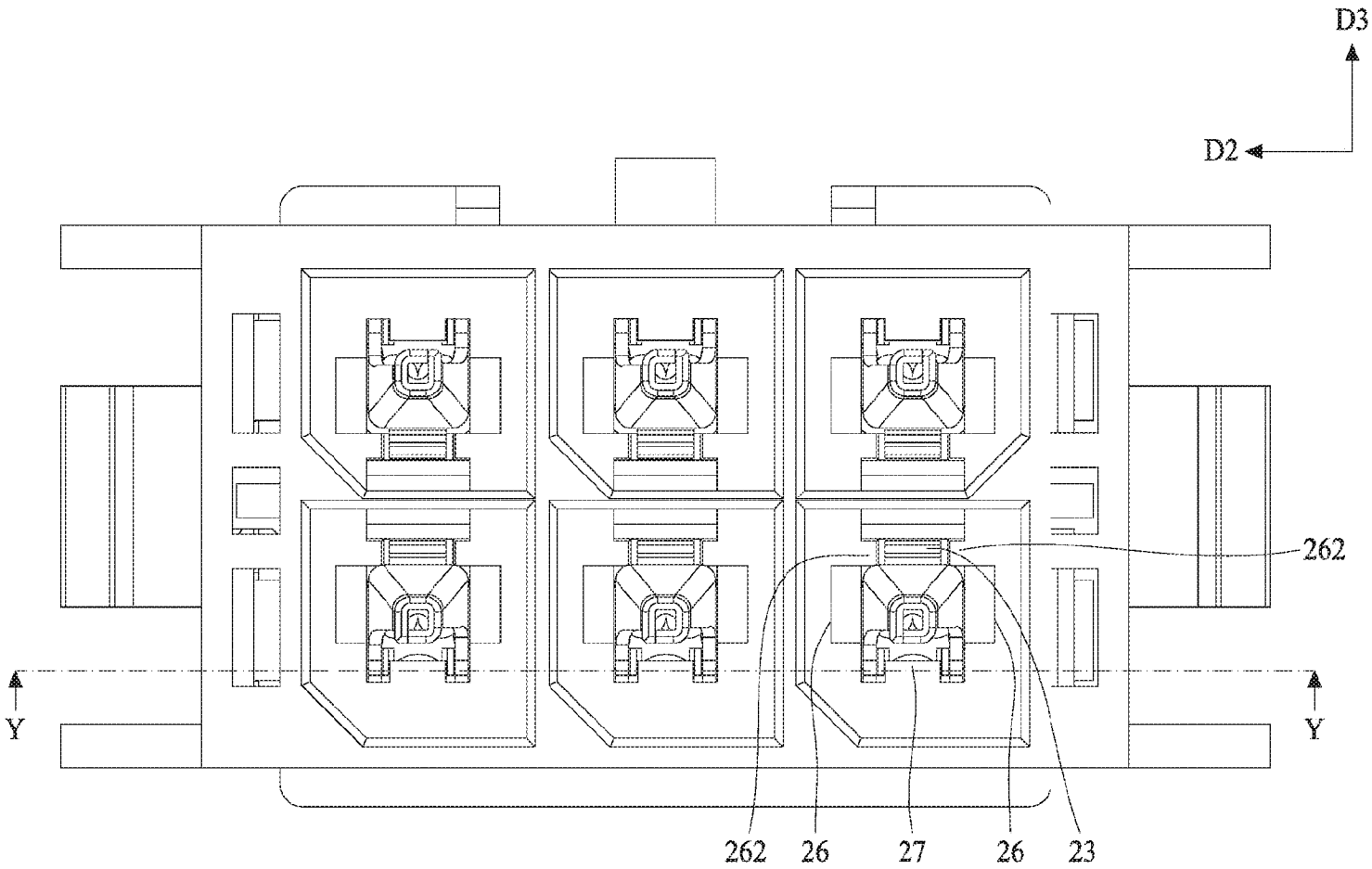
FIG. 22 is a rear view illustrating the assembled terminal and second insulative housing of FIG. 7.
Figure 23:
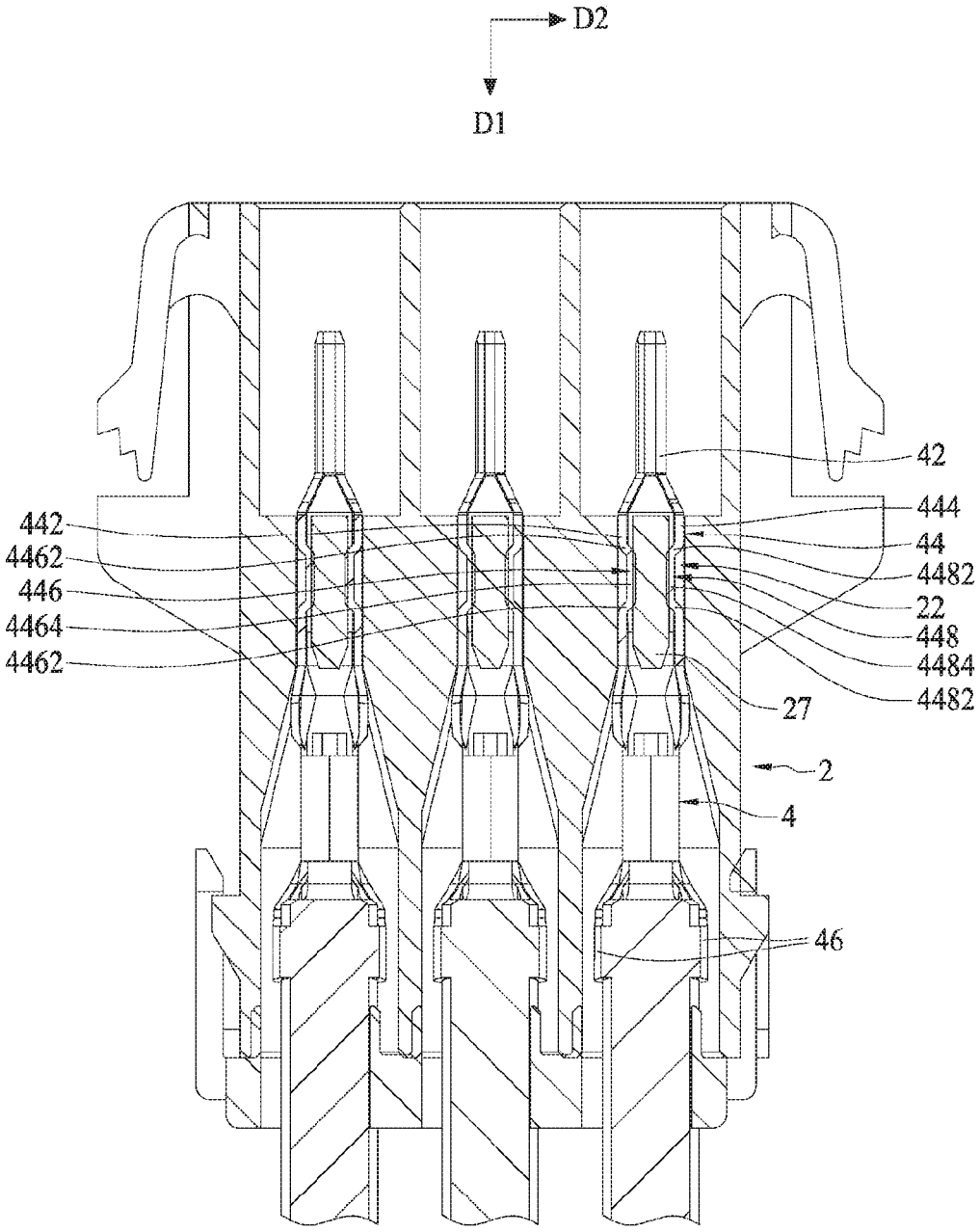
FIG. 23 is a cross-sectional view illustrating the assembled terminal and second insulative housing taken along a line Y-Y.

FIG. 22 is a rear view illustrating the assembled terminal 4 and second insulative housing 2 of FIG. 7. FIG. 23 is a cross-sectional view illustrating the assembled terminal 4 and second insulative housing 2 taken along a line Y-Y. Referring to FIG. 22 and FIG. 23, the second insulative housing 2 defines a terminal receiving groove 22 therein. The second insulative housing 2 comprises a rib portion 27 and a cantilever beam 23, the rib portion 27 protrudes from the second insulative housing 2 into the terminal receiving groove 22. The terminal 4 is positioned in the terminal receiving groove 22. The terminal 4 comprises a mating portion 42, a clamping portion 44 and a wire connecting portion 46. The mating portion 42, the clamping portion 44 and the wire connecting portion 46 are arranged in the front-rear direction D1 and sequentially connected. The clamping portion 44 comprises a first side wall 442, a second side wall 444, a first clamping arm 446 and a second clamping arm 448.

The first clamping arm 446 comprises two first end portions 4462 and a first middle portion 4464. The first middle portion 4464 is positioned between the two first end portions 4462, and protrudes toward the second side wall 444. The two first end portions 4462 are respectively connected with the first side wall 442. The second clamping arm 448 comprises two second end portions 4482 and a second middle portion 4484. The second middle portion 4484 is positioned between the two second end portions 4482, and protrudes toward the first side wall 442. The two second end portions 4482 are respectively connected with the second side wall 444.

When the terminal 4 is assembled with the second insulative housing 2, the first middle portion 4464 of the first clamping arm 446 and the second middle portion 4484 of the second clamping arm 448 together clamp the rib portion 27 of the second insulative housing 2 to fix the terminal 4 to the second insulative housing 2.

In the present disclosure, the terminal 4 may be a male terminal. Generally, in the design of the power connector, in order to ensure good contact performance, the female terminal is movable in the plastic body, and the plug terminal is less movable as possible. The present disclosure utilizes the cooperation between the first clamping arm 446 and the second clamping arm 448 of the terminal 4 and the rib portion 27 of the second insulative housing 2 to reinforce the fixing of the terminal 4.

Figure 24:
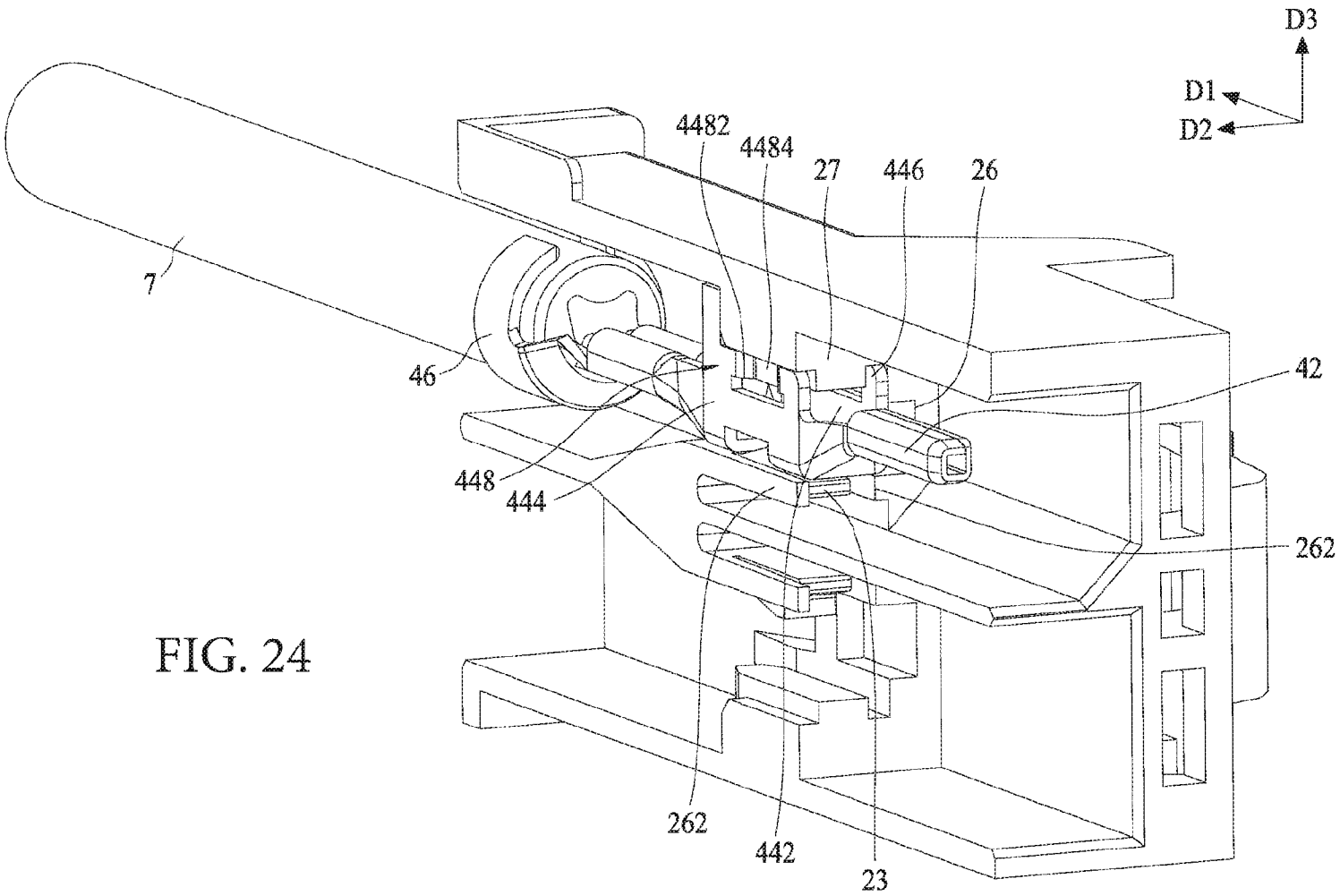
FIG. 24 is a cross-sectional schematic view illustrating the assembled terminal and second insulative housing of FIG. 7.

FIG. 24 is a cross-sectional schematic view illustrating the assembled terminal 4 and second insulative housing 2 of FIG. 7. With referring to FIG. 22 and FIG. 24 at the same time, the second insulative housing 2 further comprises two side walls 26. The two side walls 26 face each other and are positioned in the left-right direction D2. A stopping block 262 extending into the terminal receiving groove 22 and supporting the terminal 4 is provided to each of the two side walls 26. Generally, in the prior art, only the cantilever beam 23 is used to support and fix the position of the terminal in the up-down direction D3 in the insulative housing, however, the cantilever beam 23 will be elastic fatigue and deformed as the use time elapses, which will make the position of the terminal in the up-down direction D3 changed. In the present disclosure, the stopping block 262 is used to further fix the position of the terminal 4 in the up-down direction D3 in the second insulative housing 2. It is relatively better to reinforce of the fixing of the terminal 4 in the up-down direction D3.

The present disclosure, a portion of the first horizontal portion 342 and a portion of the second horizontal portion 344 in the stopping portion 34 of the terminal 3 are cut off in an embodiment, or a portion of the first horizontal portion 342, a portion of the second horizontal portion 344, a portion of the first bent portion 341 and a portion of the second bent portion 343 are cut off in another embodiment, so that the first front end edge 3422 and the second front end edge 3442 of the stopping portion 34 will not splay forwardly and outwardly to protrude forwardly after the terminal 3 is subjected to the bending and wire pressing process, so as to avoid that the first front end edge 3422 and the second front end edge 3442 of the stopping portion 34 of the terminal 3 abuts against the stopping wall 16 of the first insulative housing 1 first when the terminal 3 is assembled with the first insulative housing 1, so that the terminal 3 can be mounted to the correct position in the first insulative housing 1.

The first elastic arm 136 and the second elastic arm 137 of the lock assembly 13 are added in the present disclosure, different from the prior art, the first elastic arm 136 and the second elastic arm 137 do not extend outwardly respectively from the left and right ends of the rear bracket 1324 of the lock assembly 13 and then are directly connected downwardly with the first insulative housing 1, but the first elastic arm 136 and the second elastic arm 137 extend outwardly respectively from the left and right ends of the rear bracket 1324 of the lock assembly 13, then firstly extend forwardly by a certain distance, and then are connected downwardly with the first insulative housing 1. This design can increase the flexibility of the lock assembly 13, and improve the problem that the pressing handle of the lock assembly B11 in the prior art is difficult to press down.

The present disclosure utilizes the design of the first clamping arm 446 and the second clamping arm 448 of the terminal 4 and the rib portion 27 of the second insulative housing 2 to reinforce the fixing of the terminal 4, and ensures the good contact performance of the power connector.

Features of some embodiments are summarized in above content, so that a person skilled in the art may better understand various aspects of the present disclosure. A person skilled in the art shall understand that the present disclosure may be easily used to design or modify other configurations and in turn to realize the same object and/or attain the same advantage as the embodiments of the present disclosure. A person skilled in the art shall also understand that, such equivalent configurations cannot be departed from the spirit and scope of the disclosed content of the present disclosure, and a person skilled in the art may make various changes, substitutions and replacements, which are not departed from the spirit and scope of the disclosed content of the present disclosure. The above is only exemplary, which is not limited. Any equivalent variations or modifications that are not departed from the spirit and scope of the present disclosure should be included in the appended claims.

What is claimed is:

1. A power connector, comprising:

an insulative housing defining a terminal receiving groove therein, the insulative housing comprising:

a rib portion protruding from the insulative housing into the terminal receiving groove; and a terminal positioned in the terminal receiving groove of the insulative housing, the terminal comprising:

a mating portion;

a clamping portion connecting with the mating portion, the clamping portion comprising:

a first side wall;

a second side wall facing the first side wall, the first side wall and the second side wall being positioned in a left-right direction;

a first clamping arm having two first end portions and a first middle portion positioned between the two first end portions, the two first end portions being respectively connected with the first side wall, the first middle portion protruding toward the second side wall; and a second clamping arm having two second end portions and a second middle portion positioned between the two second end portions, the two second end portions being respectively connected with the second side wall, the second middle portion protruding toward the first side wall;

the first middle portion of the first clamping arm and the second middle portion of the second clamping arm clamping and being fixed to the rib portion of the insulative housing; and a wire connecting portion connecting with the clamping portion.

2. The power connector according to claim 1, wherein the insulative housing further comprises two side walls positioned in the left-right direction, a stopping block extending into the terminal receiving groove is provided to each of the two side walls, the stopping blocks of the two side walls support the terminal.

* * * * *